US011504588B2

(12) United States Patent
Barker et al.

(10) Patent No.: US 11,504,588 B2
(45) Date of Patent: Nov. 22, 2022

(54) RUSTY OXIDIZABLE METAL FACE GOLF CLUB HEAD

(71) Applicant: Taylor Made Golf Company, Inc, Carlsbad, CA (US)

(72) Inventors: Peter Barker, Escondido, CA (US); Paul Demkowski, Cardiff, CA (US); Giancarlo Bruschi, San Diego, CA (US); Bill Price, Santa Ana, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

(21) Appl. No.: 16/434,162

(22) Filed: Jun. 6, 2019

(65) Prior Publication Data

US 2019/0374822 A1 Dec. 12, 2019

Related U.S. Application Data

(60) Provisional application No. 62/681,548, filed on Jun. 6, 2018.

(51) Int. Cl.
*A63B 53/04* (2015.01)
*A63B 60/00* (2015.01)

(52) U.S. Cl.
CPC ..... *A63B 53/047* (2013.01); *A63B 60/00* (2015.10); *A63B 53/0445* (2020.08); *A63B 2209/00* (2013.01)

(58) Field of Classification Search
CPC ..... A63B 53/047; A63B 2053/0445; A63B 2209/00
See application file for complete search history.

(56) References Cited

U.S. PATENT DOCUMENTS

| | | | |
|---|---|---|---|
| D420,079 | S | 2/2000 | Frazetta |
| 6,089,993 | A | 7/2000 | Woodward et al. |
| 7,032,639 | B2 | 4/2006 | Lukasiewicz et al. |
| 7,594,863 | B2 | 9/2009 | Ban |
| D606,605 | S | 12/2009 | Wade et al. |

(Continued)

FOREIGN PATENT DOCUMENTS

| | | |
|---|---|---|
| JP | 2013043092 | 3/2013 |
| JP | 2013169413 | 9/2013 |

(Continued)

OTHER PUBLICATIONS

The Gadgeteer, Expert Shield Screen Protector Review, Pull on the Blue Tab, https://web.archive.org/web/20171117162028/http://ghosttape.com/new/instructions/, Jul. 2014.*

(Continued)

*Primary Examiner* — William M Pierce
(74) *Attorney, Agent, or Firm* — Kunzler Bean & Adamson

(57) ABSTRACT

Described herein is a golf club head. The golf club head comprises a heel portion, a sole portion, a toe portion, opposite the heel portion, a top portion, opposite the sole portion, a rear portion, and a front portion, opposite the rear portion and comprising a strike face. An outer surface of at least the rear portion and at most a limited part of the strike face is made of a non-oxidizable metal material. At least a part of the strike face is made of an oxidizable metal material.

12 Claims, 25 Drawing Sheets

(56) References Cited

U.S. PATENT DOCUMENTS

| | | | | |
|---|---|---|---|---|
| 7,662,049 | B2 * | 2/2010 | Park | A63B 53/04 473/330 |
| 7,695,377 | B2 | 4/2010 | Yamagishi et al. | |
| 7,780,549 | B2 * | 8/2010 | Park | A63B 53/047 473/330 |
| D643,490 | S | 8/2011 | Wade et al. | |
| 8,012,036 | B2 | 9/2011 | Nakamura | |
| 8,147,352 | B2 | 4/2012 | Lee et al. | |
| 8,157,668 | B2 | 4/2012 | Wahl et al. | |
| 8,337,324 | B2 | 12/2012 | Sander et al. | |
| 8,475,296 | B2 | 7/2013 | Lee et al. | |
| 8,684,861 | B2 | 4/2014 | Carlyle et al. | |
| D707,316 | S | 6/2014 | Aguayo et al. | |
| 8,758,162 | B2 | 6/2014 | Ban | |
| 8,827,832 | B2 * | 9/2014 | Breier | A63B 53/04 473/331 |
| 8,827,833 | B2 | 9/2014 | Amano et al. | |
| 8,831,291 | B1 | 9/2014 | Ban | |
| D716,387 | S | 10/2014 | Aguayo et al. | |
| D716,388 | S | 10/2014 | Aguayo et al. | |
| 8,858,361 | B2 | 10/2014 | Ripp et al. | |
| 8,979,670 | B2 | 3/2015 | Aguayo et al. | |
| 9,033,819 | B2 | 5/2015 | Wahl et al. | |
| 9,308,422 | B2 | 4/2016 | Ripp et al. | |
| 9,440,121 | B2 | 9/2016 | Deng et al. | |
| 9,821,202 | B2 | 11/2017 | Hettinger et al. | |
| 9,975,014 | B2 | 5/2018 | Carlyle et al. | |
| 10,449,428 | B2 * | 10/2019 | Parsons | A63B 53/047 |
| 10,478,684 | B2 * | 11/2019 | Parsons | A63B 53/047 |
| 10,632,349 | B2 * | 4/2020 | Parsons | A63B 1/00 |
| 2005/0126695 | A1 * | 6/2005 | Pennerath | B29C 63/0056 156/250 |
| 2005/0137028 | A1 | 6/2005 | Lukasiewicz et al. | |
| 2005/0164800 | A1 * | 7/2005 | Wood | A63B 53/0466 473/219 |
| 2008/0242443 | A1 * | 10/2008 | Gilbert | A63B 53/047 473/331 |
| 2009/0264217 | A1 * | 10/2009 | Johnson | A63B 53/04 473/331 |
| 2009/0318243 | A1 * | 12/2009 | Golden | A63B 53/04 473/331 |
| 2010/0261538 | A1 | 10/2010 | Lee et al. | |
| 2011/0151998 | A1 * | 6/2011 | Ban | A63B 53/047 473/331 |
| 2011/0151999 | A1 * | 6/2011 | Ban | A63B 53/047 473/331 |
| 2011/0269567 | A1 | 11/2011 | Ban et al. | |
| 2012/0157225 | A1 | 6/2012 | Lee et al. | |
| 2012/0157228 | A1 | 6/2012 | Lee et al. | |
| 2012/0264537 | A1 * | 10/2012 | Breier | A63B 53/047 473/331 |
| 2013/0190102 | A1 * | 7/2013 | Greaney | A63B 53/0466 473/331 |
| 2015/0196812 | A1 | 7/2015 | Aguayo et al. | |
| 2015/0367197 | A1 | 12/2015 | Ripp et al. | |
| 2015/0367199 | A1 | 12/2015 | Shimahara et al. | |
| 2016/0001142 | A1 | 1/2016 | Carlyle et al. | |
| 2016/0175880 | A1 * | 6/2016 | Jacaman | B05D 3/007 427/385.5 |
| 2016/0310806 | A1 | 10/2016 | Wallans | |
| 2018/0185717 | A1 | 7/2018 | Demkowski et al. | |
| 2018/0189758 | A1 | 7/2018 | Beach et al. | |
| 2019/0374822 | A1 * | 12/2019 | Barker | A63B 60/00 |

FOREIGN PATENT DOCUMENTS

| | | |
|---|---|---|
| JP | 2013176510 | 9/2013 |
| JP | 2016203661 | 2/2016 |

OTHER PUBLICATIONS

Titleist, Raw vs. Finished, https://www.titleist.com/teamtitleist/teamtitleist/f/vokey-design-wedges/38321/raw-vs-finished, Aug. 2017.*

Golf Monthly, The Truth About Rusty Wedges, https://www.golfmonthly.co.uk/videos/gear-video/truth-rusty-wedges, Sep. 2019.*

Ghost Tape, Instructions, http://ghosttape.com/new/instructions/, Nov. 2017.*

Mygolfspy, First Look: Wilson Staff FG Tour V6 in Raw, https://mygolfspy.com/first-look-wilson-staff-fg-tour-v6-in-raw/, Jun. 2018.*

PE Protective Film Mnaufacturer, Stainless Steel Protective Film, http://www.pefilmsmanufacturers.com/product/Stainless-Steel-Protective-Film.html, 2017.*

3M(TM) Vinyl Tape website, https://www.3m.com/3M/en_US/company-us/all-3m-products/~/3M-Vinyl-Tape-471/?N=5002385+3293242769&rt=rud, accessed Sep. 26, 2019.

Nike Engage Wedge Review, https://pluggedingolf.com/nike-engage-wedge-review/, accessed Oct. 9, 2019.

Hopley, M., Callaway Mack Daddy 4 Wedge Review, Golfalot, Jan. 9, 2018, http://www.golfalot.com/equipment-reviews/callaway-mack-daddy-4-wedge-review-3936.aspx, accessed Oct. 9, 2019.

* cited by examiner

RUSTY OXIDIZABLE METAL FACE GOLF CLUB HEAD

CROSS-REFERENCE TO RELATED APPLICATION

This application claims the benefit of U.S. Provisional Patent Application No. 62/681,548, filed Jun. 6, 2018, which is herein incorporated by reference in its entirety.

FIELD

This disclosure relates generally to golf clubs, and more particularly to a golf club head with a non-plated strike face.

BACKGROUND

The performance of golf equipment is continuously advancing due to the development of innovative clubs and club designs. While all clubs in a golfer's bag are important, both scratch and novice golfers rely on the performance and feel of their irons, metal-woods, hybrids, and drivers for many commonly encountered playing situations.

Advancements in golf club head manufacturing techniques have facilitated the manufacturing of golf club heads with complex geometries and surface finishes. For example, features of iron-type golf club heads can be formed using casting techniques and/or milling techniques. Additionally, some iron-type golf club heads are plated with protective plating. Plating iron-type golf club heads can affect the performance and appearance of the heads. Making an iron-type golf club head that strikes an effective balance between performance and appearance can be difficult.

SUMMARY

The subject matter of the present application has been developed in response to the present state of the art, and in particular, in response to the shortcomings of golf clubs and associated golf club heads, that have not yet been fully solved by currently available techniques. Accordingly, the subject matter of the present application has been developed to provide a golf club and golf club head that overcome at least some of the above-discussed shortcomings of prior art techniques.

Described herein is a golf club head. The golf club head comprises a heel portion, a sole portion, a toe portion, opposite the heel portion, a top portion, opposite the sole portion, a rear portion, and a front portion, opposite the rear portion and comprising a strike face. An outer surface of at least the rear portion and at most a limited part of the strike face is made of a non-oxidizable metal material. At least a part of the strike face is made of an oxidizable metal material. The preceding subject matter of this paragraph characterizes example 1 of the present disclosure.

At least the rear portion and at most the limited part of the strike face comprises a first oxidation-prevention coating that defines the outer surface. The first oxidation-prevention coating permanently covers and prevents oxidation of an inner surface of at least the rear portion. The inner surface is made of an oxidizable material. The first oxidation-prevention coating defines the outer surface of at least the rear portion. The preceding subject matter of this paragraph characterizes example 2 of the present disclosure, wherein example 2 also includes the subject matter according to example 1, above.

The outer surface of the heel portion, the sole portion, the toe portion, and the top portion is made of a non-oxidizable metal material. The preceding subject matter of this paragraph characterizes example 3 of the present disclosure, wherein example 3 also includes the subject matter according to example 2, above.

An inner surface of the heel portion, the sole portion, the toe portion, and the top portion is made of an oxidizable metal material. The heel portion, the sole portion, the toe portion, and the top portion comprises the first oxidation-prevention coating. The first oxidation-prevention coating permanently covers and prevents oxidation of the inner surface of the heel portion, the sole portion, the toe portion, and the top portion. The first oxidation-prevention coating defines the outer surface of the heel portion, the sole portion, the toe portion, and the top portion. The preceding subject matter of this paragraph characterizes example 4 of the present disclosure, wherein example 4 also includes the subject matter according to example 3, above.

The golf head further comprises a second oxidation-prevention coating non-permanently covering at least some of the oxidizable metal material of the strike face. The second oxidation-prevention coating prevents oxidation of the oxidizable metal material of the strike face. The preceding subject matter of this paragraph characterizes example 5 of the present disclosure, wherein example 5 also includes the subject matter according to any one of examples 1-4, above.

The second oxidation-prevention coating non-permanently covers all of the oxidizable metal material of the strike face. The preceding subject matter of this paragraph characterizes example 6 of the present disclosure, wherein example 6 also includes the subject matter according to example 5, above.

The second oxidation-prevention coating non-permanently covers only a limited part of the oxidizable metal material of the strike face. The preceding subject matter of this paragraph characterizes example 7 of the present disclosure, wherein example 7 also includes the subject matter according to example 5, above.

The limited part of the strike face has a shape corresponding with at least one of performance indicia, informational indicia, or cosmetic indicia. The preceding subject matter of this paragraph characterizes example 8 of the present disclosure, wherein example 8 also includes the subject matter according to example 7, above.

The shape of the limited part of the strike face corresponds with performance indicia. The performance indicia comprise at least one marking identifying a center of the strike face. The preceding subject matter of this paragraph characterizes example 9 of the present disclosure, wherein example 9 also includes the subject matter according to example 8, above.

The shape of the limited part of the strike face corresponds with informational indicia. The informational indicia comprise at least one marking identifying a characteristic of the golf club head. The preceding subject matter of this paragraph characterizes example 10 of the present disclosure, wherein example 10 also includes the subject matter according to any one of examples 8-9, above.

The shape of the limited part of the strike face corresponds with cosmetic indicia. The cosmetic indicia comprise at least one marking identifying a manufacturer of the golf club head. The preceding subject matter of this paragraph characterizes example 11 of the present disclosure, wherein example 11 also includes the subject matter according to any one of examples 8-10, above.

The strike face comprises grooves. The second oxidation-prevention coating is within the grooves. The preceding subject matter of this paragraph characterizes example 12 of the present disclosure, wherein example 12 also includes the subject matter according to any one of examples 5-11, above.

The first oxidation-prevention coating comprises a metallic material. The second oxidation-prevention coating comprises a non-metallic material. The preceding subject matter of this paragraph characterizes example 13 of the present disclosure, wherein example 13 also includes the subject matter according to any one of examples 5-12, above.

The non-metallic material comprises wax. The preceding subject matter of this paragraph characterizes example 14 of the present disclosure, wherein example 14 also includes the subject matter according to example 13, above.

The second oxidation-prevention coating comprises a sticker comprising an adhesive-backed sheet. The preceding subject matter of this paragraph characterizes example 15 of the present disclosure, wherein example 15 also includes the subject matter according to any one of examples 13-14, above.

The non-metallic material comprises a water-soluble material. The preceding subject matter of this paragraph characterizes example 16 of the present disclosure, wherein example 16 also includes the subject matter according to any one of examples 13-15, above.

The second oxidation-prevention coating comprises at least one of performance indicia, informational indicia, or cosmetic indicia. The preceding subject matter of this paragraph characterizes example 17 of the present disclosure, wherein example 17 also includes the subject matter according to any one of examples 5-16, above.

An entirety of the strike face is made of oxidizable metal material. The preceding subject matter of this paragraph characterizes example 18 of the present disclosure, wherein example 18 also includes the subject matter according to any one of examples 5-17, above.

A ratio of a surface area of the strike face made of the oxidizable metal material to a total surface area of the strike face is at least 0.70, inclusive. The preceding subject matter of this paragraph characterizes example 19 of the present disclosure, wherein example 19 also includes the subject matter according to any one of examples 1-18, above.

The ratio of the surface area of the strike face made of the oxidizable metal material to the total surface area of the strike face is between 0.74 and 1.0, inclusive. The preceding subject matter of this paragraph characterizes example 20 of the present disclosure, wherein example 20 also includes the subject matter according to example 19, above.

A value of a surface area of the strike face made of the oxidizable metal material divided by a total volume of the body is at least 0.05 per mm, inclusive. The preceding subject matter of this paragraph characterizes example 21 of the present disclosure, wherein example 21 also includes the subject matter according to any one of examples 1-20, above.

The value of the surface area of the strike face made of the oxidizable metal material divided by the total volume of the body is between 0.055 and 0.12 per mm, inclusive. The preceding subject matter of this paragraph characterizes example 22 of the present disclosure, wherein example 22 also includes the subject matter according to example 21, above.

An entirety of the strike face is made of the oxidizable metal. The strike face is separately attached to the front portion. The preceding subject matter of this paragraph characterizes example 23 of the present disclosure, wherein example 23 also includes the subject matter according to any one of examples 1-22, above.

An outer surface of the heel portion, the sole portion, the toe portion, the top portion, and the front portion is made of a non-oxidizable metal material. The preceding subject matter of this paragraph characterizes example 24 of the present disclosure, wherein example 24 also includes the subject matter according to example 23, above.

Further disclosed herein is an iron-type golf club head. The iron-type golf club head comprises a heel portion, a sole portion, a toe portion, opposite the heel portion, a top portion, opposite the sole portion, a rear portion, and a front portion, opposite the rear portion and comprising a strike face. An inner surface of at least the rear portion, and an entirety of the strike face is made of an oxidizable metal material. The rear portion comprises a first oxidation-prevention coating that permanently covers and prevents oxidation of the inner surface of at least the rear portion. The iron-type golf club head additionally comprises a second oxidation-prevention coating non-permanently covering all of the oxidizable metal material of the strike face. The second oxidation-prevention coating prevents oxidation of the oxidizable metal material of the strike face and is made of a non-metallic material. The preceding subject matter of this paragraph characterizes example 25 of the present disclosure.

An inner surface of the heel portion, the sole portion, the toe portion, and the top portion is made of an oxidizable metal material. The heel portion, the sole portion, the toe portion, and the top portion comprises the first oxidation-prevention coating. The first oxidation-prevention coating permanently covers and prevents oxidation of the inner surface of the heel portion, the sole portion, the toe portion, and the top portion. The preceding subject matter of this paragraph characterizes example 26 of the present disclosure, wherein example 26 also includes the subject matter according to example 25, above.

The second oxidation-prevention coating has an adhesion strength of within 0.15 and 1.35 of 26 oz/in (280 N/m). The preceding subject matter of this paragraph characterizes example 27 of the present disclosure, wherein example 27 also includes the subject matter according to example 25, above.

The golf club head further comprises a non-stick tab coupled to a periphery of the second oxidation-prevention coating. The preceding subject matter of this paragraph characterizes example 28 of the present disclosure, wherein example 28 also includes the subject matter according to example 25, above.

Additionally disclosed herein is a method for making a golf club head comprising a heel portion, a sole portion, a toe portion opposite the heel portion, a top portion that is opposite the sole portion, a rear portion, and a front portion that is opposite the rear portion and comprises a strike face. The heel portion, the sole portion, the toe portion, the top portion, the rear portion, and the front portion are made of an oxidizable metal material. The method comprises permanently covering the heel portion, the sole portion, the toe portion, the top portion, and the rear portion with a first oxidation-prevention coating. The method also comprises leaving permanently uncovered, from the first oxidation-prevention coating, at most a limited part of the strike face. The preceding subject matter of this paragraph characterizes example 29 of the present disclosure.

The method further comprises non-permanently covering at least some of the strike face, left uncovered by the first oxidation-prevention coating, with a second oxidation-prevention coating that prevents oxidation of the at least some of the strike face left permanently uncovered. The preceding subject matter of this paragraph characterizes example 30 of the present disclosure, wherein example 30 also includes the subject matter according to example 29, above.

The method further comprises selectively removing the second oxidation-prevention coating from the at least some of the strike face left permanently uncovered. The method further also comprises oxidizing the at least some of the strike face left permanently uncovered. The preceding subject matter of this paragraph characterizes example 31 of the present disclosure, wherein example 31 also includes the subject matter according to example 30, above.

The step of selectively removing the second oxidation-prevention coating comprises one of dissolving, evaporating, or melting the second oxidation-prevention coating. The preceding subject matter of this paragraph characterizes example 32 of the present disclosure, wherein example 32 also includes the subject matter according to example 31, above.

The step of permanently covering the heel portion, the sole portion, the toe portion, the top portion, and the rear portion with the oxidation-prevention coating comprises dipping the golf club head in a bath of plating material. The step of leaving uncovered, from the first oxidation-prevention coating, at most a limited part of the strike face comprises covering the at most a limited part of the strike face with a masking material prior to dipping the golf club head in the bath of plating material, and after dipping the golf club head in the bath of plating material, removing the masking material from the at most a limited part of the strike face. The preceding subject matter of this paragraph characterizes example 33 of the present disclosure, wherein example 33 also includes the subject matter according to any one of examples 29-32, above.

The front portion comprises a strike plate defining the strike face. The method further comprises forming the strike plate separately from the heel portion, the sole portion, the toe portion, the top portion, and the rear portion. The step of permanently covering the heel portion, the sole portion, the toe portion, the top portion, and the rear portion with the first oxidation-prevention coating comprises dipping only the heel portion, the sole portion, the toe portion, the top portion, and the rear portion in a bath of plating material. The step of leaving uncovered, from the first oxidation-prevention coating, at most a limited part of the strike face comprises attaching the strike plate to the front portion after permanently covering the heel portion, the sole portion, the toe portion, the top portion, and the rear portion with the first oxidation-prevention coating. The preceding subject matter of this paragraph characterizes example 34 of the present disclosure, wherein example 34 also includes the subject matter according to any one of examples 29-33, above.

In another examples, an iron-type golf club head comprises a heel portion, a sole portion, a toe portion opposite the heel portion, a top portion opposite the sole portion, a rear portion, and a front portion opposite the rear portion and comprising a strike face. An inner surface of at least the rear portion and an entirety of the strike face is made of an oxidizable metal material. The rear portion comprises a first oxidation-prevention coating that permanently covers and prevents oxidation of the inner surface of at least the rear portion. A value of a total surface area of the strike face made of the oxidizable metal material divided by a total volume of the body is at least 0.05 per mm, inclusive. A value of the surface area of the strike face not permanently covered by the first oxidation-prevention coating divided by a body volume of the golf club head is at least 0.05 per mm, inclusive. The body volume of the golf club head excludes a hosel portion of the body and is measured from a par line of the golf club head to a toe-ward most portion of the golf club head. The preceding subject matter of this paragraph characterizes example 35 of the present disclosure.

A ratio of the surface area of the strike face not permanently covered by the first oxidation-prevention coating divided by a total surface area of the strike face is at least 0.70, inclusive. The preceding subject matter of this paragraph characterizes example 36 of the present disclosure, wherein example 36 also includes the subject matter according to example 35, above.

The first oxidation-prevention coating comprises a copper alloy. The preceding subject matter of this paragraph characterizes example 37 of the present disclosure, wherein example 37 also includes the subject matter according to example 36, above.

The first oxidation-prevention coating comprises a nickel alloy. The preceding subject matter of this paragraph characterizes example 38 of the present disclosure, wherein example 38 also includes the subject matter according to any one of examples 36-37, above.

The first oxidation-prevention coating comprises a chrome alloy. The preceding subject matter of this paragraph characterizes example 39 of the present disclosure, wherein example 39 also includes the subject matter according to any one of examples 36-38, above.

The first oxidation-prevention coating is formed using a physical vapor deposition (PVD) technique. The preceding subject matter of this paragraph characterizes example 40 of the present disclosure, wherein example 40 also includes the subject matter according to any one of examples 36-39, above.

The first oxidation-prevention coating is formed using a quench-polish-quenching (QPQ) technique. The preceding subject matter of this paragraph characterizes example 41 of the present disclosure, wherein example 41 also includes the subject matter according to any one of examples 36-40, above.

The first oxidation-prevention coating has a thickness of at least 0.5 microns. The preceding subject matter of this paragraph characterizes example 42 of the present disclosure, wherein example 42 also includes the subject matter according to any one of examples 36-41, above.

The first oxidation-prevention coating has a thickness of at least 2.5 microns. The preceding subject matter of this paragraph characterizes example 43 of the present disclosure, wherein example 43 also includes the subject matter according to any one of examples 36-42, above.

The first oxidation-prevention coating has a thickness of at least 20 microns. The preceding subject matter of this paragraph characterizes example 44 of the present disclosure, wherein example 44 also includes the subject matter according to any one of examples 36-43, above.

The first oxidation-prevention coating has a thickness less than 1 micron. The preceding subject matter of this paragraph characterizes example 45 of the present disclosure, wherein example 45 also includes the subject matter according to any one of examples 36-44, above.

The first oxidation-prevention coating has a thickness of at least 0.1 microns. The preceding subject matter of this paragraph characterizes example 46 of the present disclosure, wherein example 46 also includes the subject matter according to example 45, above.

The surface area of the strike face not permanently covered by the first oxidation-prevention coating is at least 2400 mm2. The preceding subject matter of this paragraph characterizes example 47 of the present disclosure, wherein example 47 also includes the subject matter according to any one of examples 36-46, above.

The golf club head further comprises a second oxidation-prevention coating non-permanently covering at least a portion of the surface area of the strike face not permanently covered by the first oxidation-prevention coating. The second oxidation-prevention coating prevents oxidation of the oxidizable metal material of the strike face. The preceding subject matter of this paragraph characterizes example 48 of the present disclosure, wherein example 48 also includes the subject matter according to example 47, above.

The second oxidation-prevention coating non-permanently covers all of the oxidizable metal material of the strike face not covered by the first oxidation-prevention coating. The preceding subject matter of this paragraph characterizes example 49 of the present disclosure, wherein example 49 also includes the subject matter according to any one of examples 47-48, above.

The second oxidation-prevention coating has a surface area of at least 2400 mm2. The preceding subject matter of this paragraph characterizes example 50 of the present disclosure, wherein example 50 also includes the subject matter according to any one of examples 47-49, above.

The second oxidation-prevention coating has a surface area that is at least 10% greater than the surface area of the strike face not permanently covered by the first oxidation-prevention coating. The preceding subject matter of this paragraph characterizes example 51 of the present disclosure, wherein example 51 also includes the subject matter according to any one of examples 47-50, above.

The second oxidation-prevention coating non-permanently covers at least a portion of at least the sole portion and top portion of the golf club head. The preceding subject matter of this paragraph characterizes example 52 of the present disclosure, wherein example 52 also includes the subject matter according to any one of examples 47-51, above.

The second oxidation-prevention coating has a width that is at least 10% greater than a heel-toe width of the portion of the strike face not permanently covered by the first oxidation-prevention coating. The preceding subject matter of this paragraph characterizes example 53 of the present disclosure, wherein example 53 also includes the subject matter according to any one of examples 47-52, above.

The second oxidation-prevention coating has a surface area that is at least 2900 mm2. The preceding subject matter of this paragraph characterizes example 54 of the present disclosure, wherein example 54 also includes the subject matter according to any one of examples 47-53, above.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

The following describes embodiments of golf club heads in the context of an iron-type golf club, but the principles, methods and designs described may be applicable in whole or in part to utility golf clubs (also known as hybrid golf clubs), metal-wood-type golf clubs, driver-type golf clubs, putter-type golf clubs, and the like.

The various embodiments of a golf club head described herein include a body where a portion of the body, excluding at least a portion of a strike face of the body, is made of or permanently coated with a non-oxidizable metal material and at least a portion of the strike face is raw (e.g., made of an oxidizable metal material). In some implementations, the golf club head includes an oxidation-prevention coating non-permanently covering at least a portion of the raw strike face.

Because the strike face is raw, exposure of the strike face to air results in oxidation (e.g., rusting) of the strike face. Oxidation of the strike face introduces oxidized surface textures to the surface of the strike face, which dulls the appearance of the strike face and may increase the face roughness which may promote spin of a golf ball impacted by the strike face. A dull strike face helps reduce glare, which can impede a player's vision when in the address position over the golf club head. Additionally, an oxidized strike face promotes a better feel at impact with the golf ball. Accordingly, for some golfers, oxidation of the strike face is desirable. However, golfers may also prefer to have portions of the golf club head, other than the strike face, to be free of oxidation (e.g., have a shiny or less-dull finish). Accordingly, in some examples, the golf club head of the present disclosure includes an oxidation-prevention coating permanently covering portions of the golf club head excluding the strike face. Additionally, golfers may prefer to control the initiation of oxidation of the strike face. In other words, it may be undesirable to golfers to purchase golf clubs with existing oxidation of the strike face. Rather, golfers may desire to purchase golf clubs with a raw and unoxidized strike face at the time of purchase and allow oxidation of the strike face only after purchase. Furthermore, manufacturers of golf clubs with a raw strike face may desire to spatially and temporally regulate oxidation on the strike face to introduce oxidation-defined indicia on the strike face.

Figure 1:
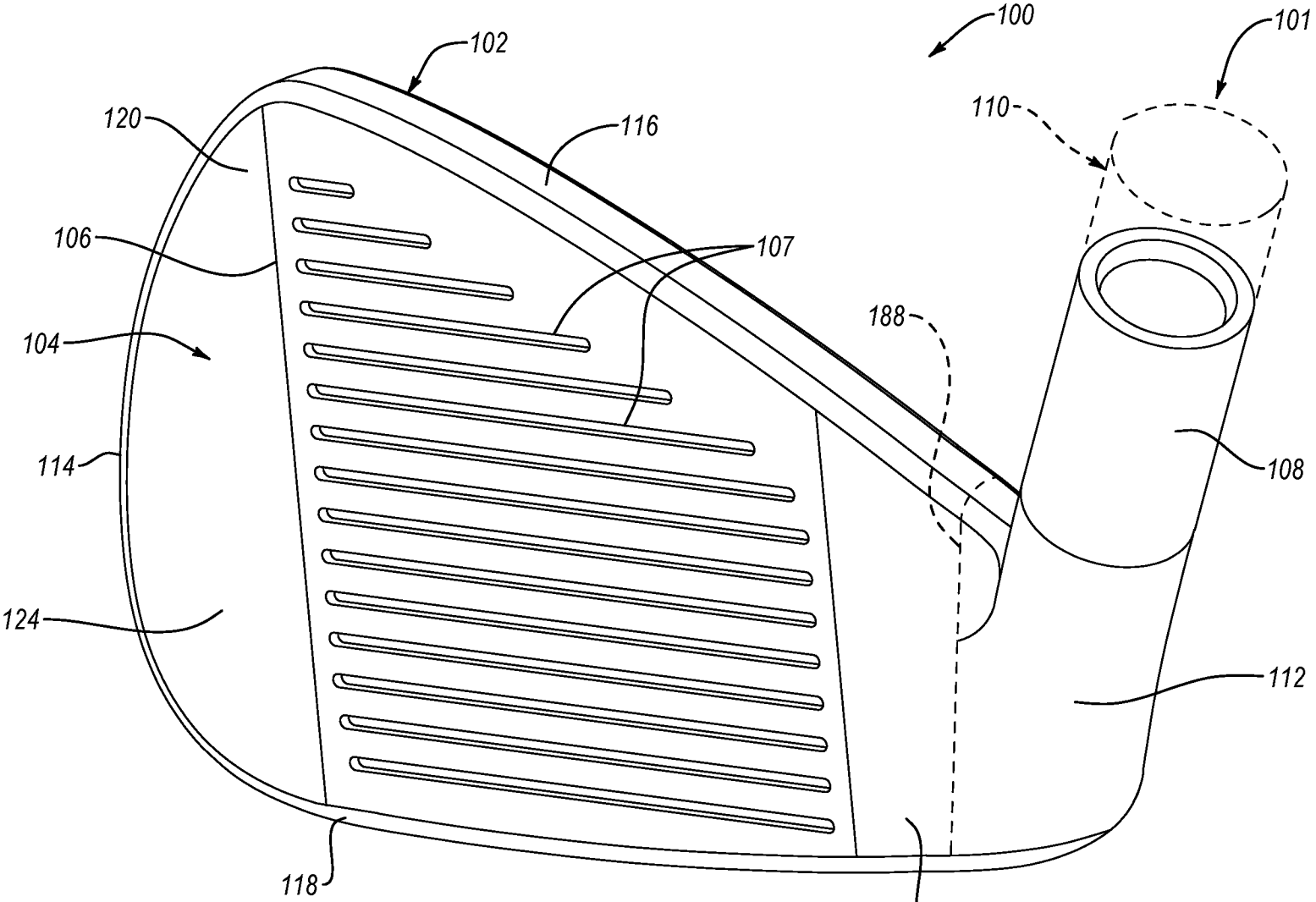
FIG. 1 is a perspective view from a top of an iron-type golf club head, according to one or more examples of the present disclosure.
Figure 2:
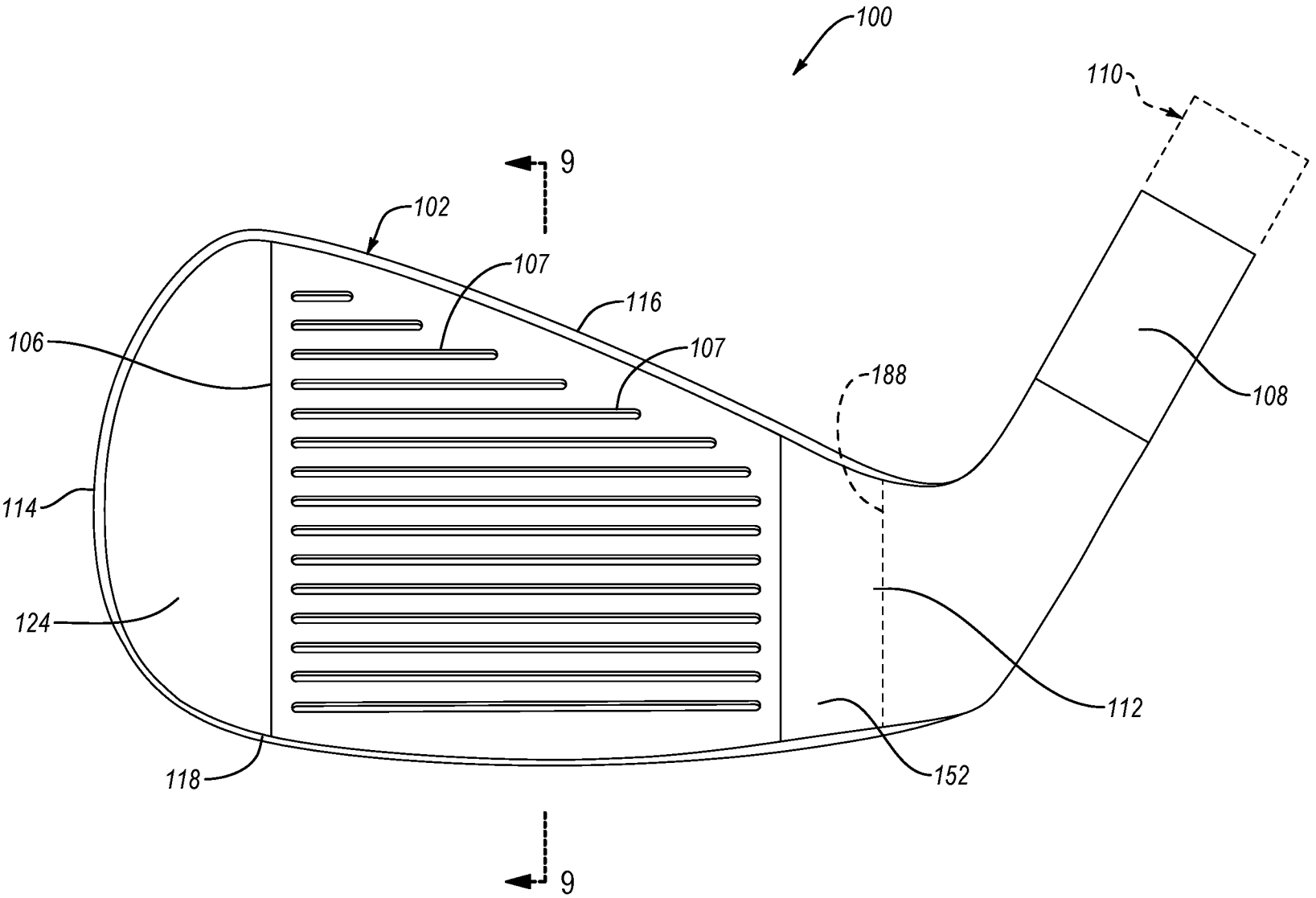
FIG. 2 is a front view of the golf club head of FIG. 1, according to one or more examples of the present disclosure.

Referring to FIGS. 1 and 2, one embodiment of a golf club head 100 includes a body 102. The body 102 has a toe portion 114, a heel portion 112, a top portion 116 (e.g., top-line portion for iron-type golf club heads and crown portion for driver-type, hybrid-type, and metal-wood-type golf club heads), and a sole portion 118 (e.g., bottom portion). Additionally, the body 102 includes a front portion 124 and a rear portion 125 (see, e.g., FIG. 9), where the front portion 124 is opposite the rear portion 125. The body 102 additionally includes a hosel 108 extending from the heel portion 112. The hosel 108 is configured to receive and engage with a shaft and grip combination 110 of a golf club 101. The shaft of the shaft and grip combination 110 extends from the hosel 108 and the grip of the shaft and grip combination 110 is secured to the shaft at a location on the shaft opposite that of the golf club head 100.

The front portion 124 of the golf club head 100 includes a strike face 106 (e.g., strike surface) designed to impact a golf ball during a normal golf swing. In one embodiment, the strike face 106 is a raw strike face. Generally, for many iron-type golf club heads, such as the golf club head 100, the strike face 106 has a planar surface that is angled relative to a ground plane when the golf club head 100 is in an address position to define a loft of the golf club head 100. In other words, in some examples, the strike face 106 of an iron-type golf club head generally does not include a curved surface. As defined generally herein, the strike face 106 of the iron-type golf club head 100 is the portion of the front portion 124 with an outwardly facing planar surface. Therefore, the strike face 106 does not include the curved transition region between the hosel and a par line 188 of the golf club head 100. As defined herein, the par line 188 is the theoretical line defining the transition on the front portion 124 between a flat surface to a curved surface generally proximate to the heel end of the golf club head. Put another way, the par line 188 defines where the flat surface of the front portion 124 ends and the curved surface of the front portion 124 begins. In contrast, the strike face of a metal-wood, driver, or hybrid golf club head does have a curved surface that curves around a substantially upright axis. More specifically, the strike face of a metal-wood, driver, and hybrid golf club head is defined as the portion of the strike face with an outwardly facing surface curved about an upright axis, as opposed to a horizontal axis.

Although in the illustrated examples, the strike face 106 has a flat or planar surface, in some examples, the strike face 106 can be curved. Accordingly, in some examples, the strike face 106 is defined as the portion of the body 102 designed to impact a golf ball during a normal golf swing and has a flat or curved surface.

Although not necessarily, the strike face 106 of the iron-type golf club head 100 can be further defined as the portion of the front portion 124 that includes grooves 107 or scorelines. The grooves 107 are formed in the strike face 106 of the front portion 124 to promote desirable flight characteristics (e.g., backspin) of the golf ball upon being impacted by the strike face 106. Each of the grooves 107 can be substantially linear and extend lengthwise in a heel-to-toe (e.g., horizontal) direction across the strike face 106. Moreover, the grooves 107 are parallel to each other. In some examples, based on the shape of the front portion 124, some of the grooves 107 can have lengths different than others of the grooves 107.

According to the example shown in FIGS. 1 and 2, the grooves 107 extend along the front portion 124 of the iron-type golf club head 100 from a first location heelward of the toe portion 114 to a second location toeward of the hosel 108. The ends of the grooves 107 at the first location can be aligned in a bottom-to-top (e.g., vertical) direction. In contrast, the ends of only some of the grooves 107 at the second location are aligned, such that these grooves 107 have the same length, and the ends of the others of the grooves 107 at the second location are staggered, such that these grooves 107 have decreasing lengths in the bottom-to-top direction. With such a configuration of the grooves 107, the strike face 106, as indicated by dashed line, has a substantially trapezoidal shape, such as a right trapezoid. Although not shown, the strike face 106 may further include micro-grooves between the grooves 107. The micro-grooves may be narrower and/or shallower than the grooves 107. Such micro-grooves can promote spin characteristics of the golf club head 100.

Figure 3:
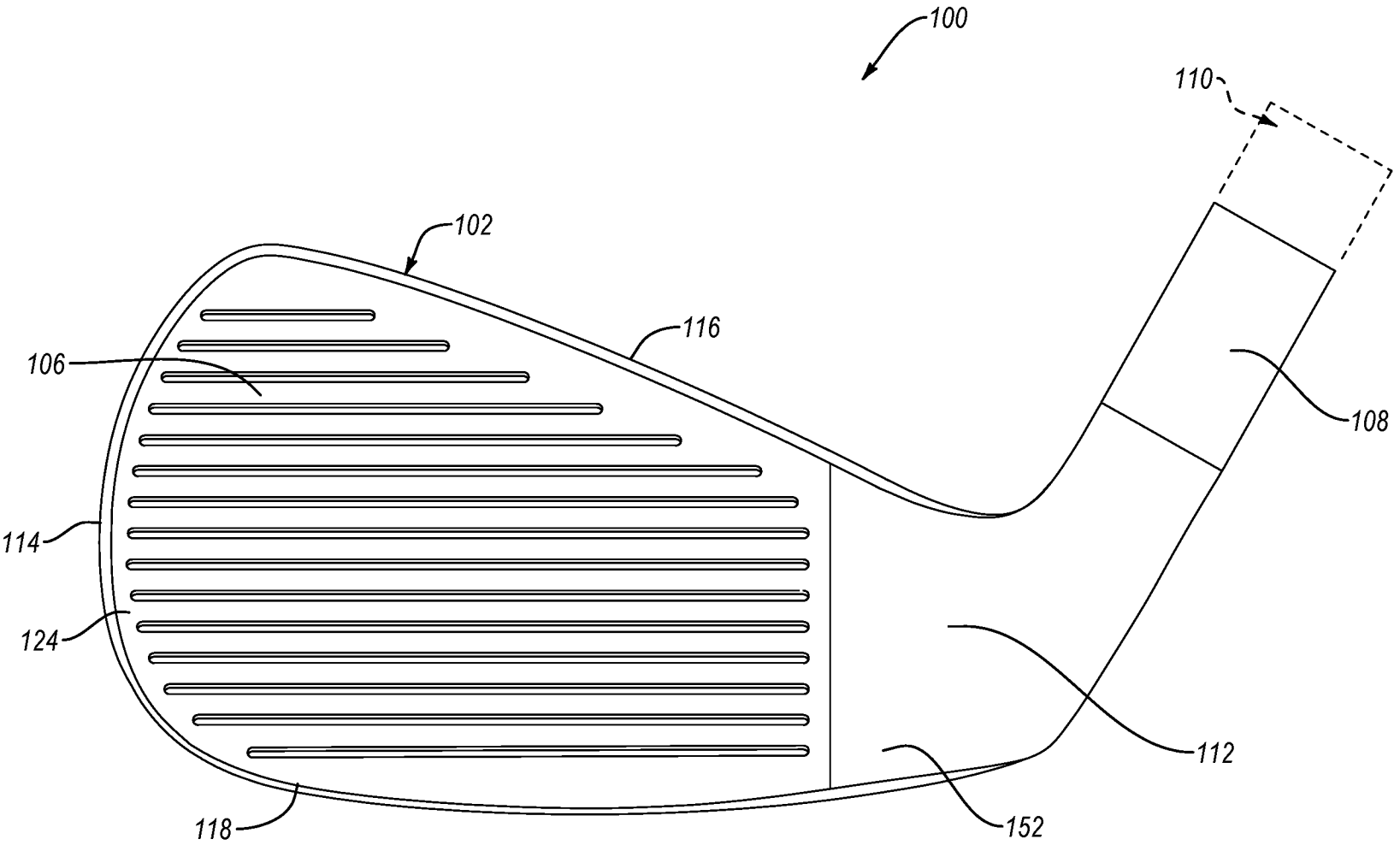
FIG. 3 is a front view of an iron-type golf club head, according to one or more examples of the present disclosure.

In an alternative example shown in FIG. 3, the grooves 107 extend along the front portion 124 up to the toe portion 114. In other words, the portion of the front portion 124 between the grooves 107 and the toe portion 114, which is unoccupied with grooves in the example of FIGS. 1 and 2, is occupied with grooves 107 in the example of FIG. 3. In this manner, more of the front portion 124 of the iron-type golf club head 100 of FIG. 3 can be useable for proper ball striking compared with the iron-type golf club head 100 of FIGS. 1 and 2. Accordingly, the strike face 106 includes all of the front portion 124 on the toeward side of the front portion 124 up to the toe portion 114. For this reason, the strike face 106 of the iron-type golf club head 100 of FIG. 3 is relatively larger than that of the iron-type golf club head 100 of FIGS. 1 and 2.

The iron-type golf club head 100 of FIGS. 1-3 represents golf club heads where the front portion 124, including the strike face 106, is co-formed with the toe portion 114, the heel portion 112, the top portion 116, the sole portion 118, and the rear portion 125. According to this configuration, the entire body 102 of the iron-type golf club head 100 forms a one-piece, unitary, and monolithic construction. In some examples, the entire body 102 is formed via one of a casting technique or a forging technique.

Figure 4:
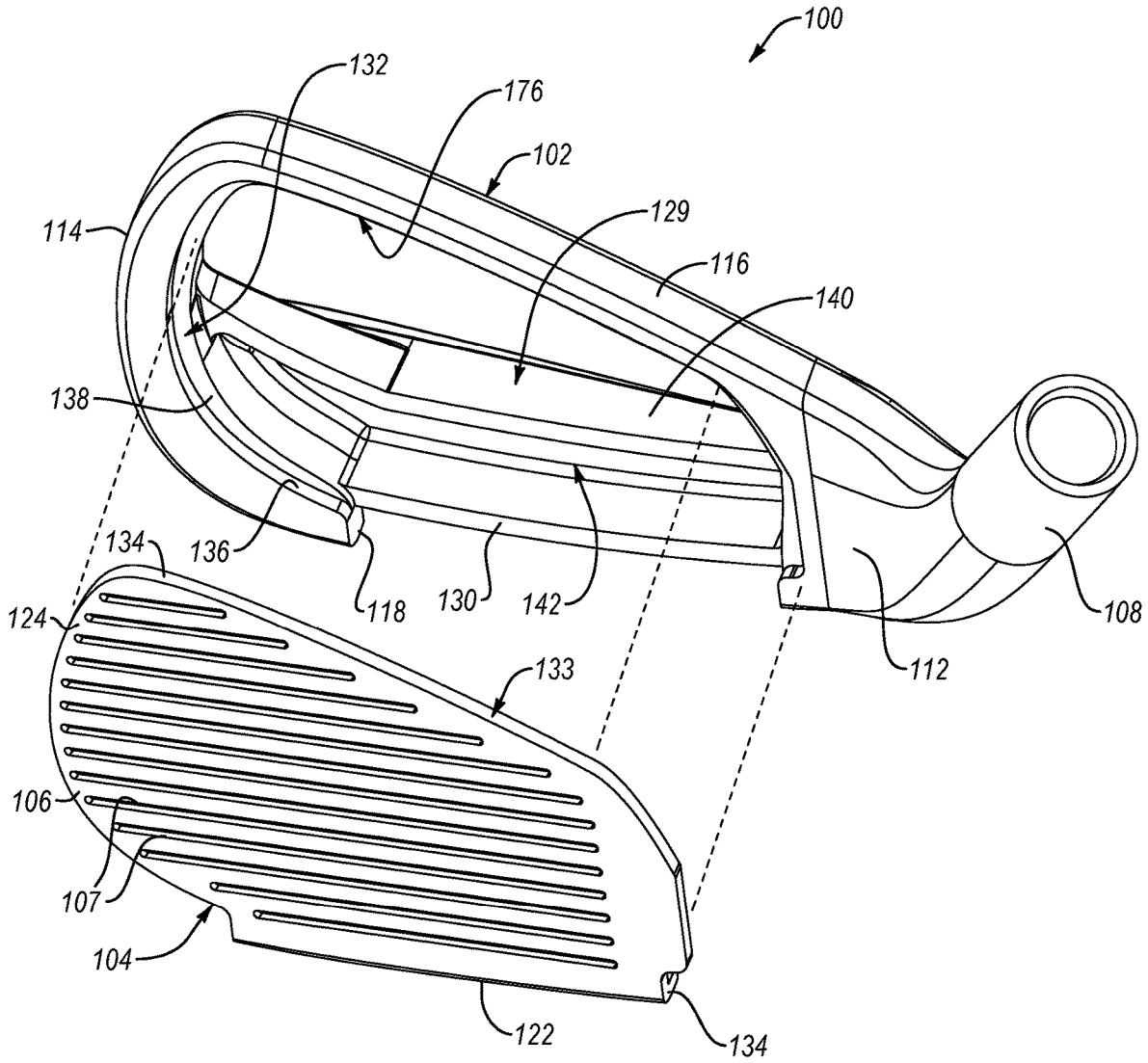
FIG. 4 is an exploded perspective view from a front of an iron-type golf club head, according to one or more examples of the present disclosure.
Figure 5:
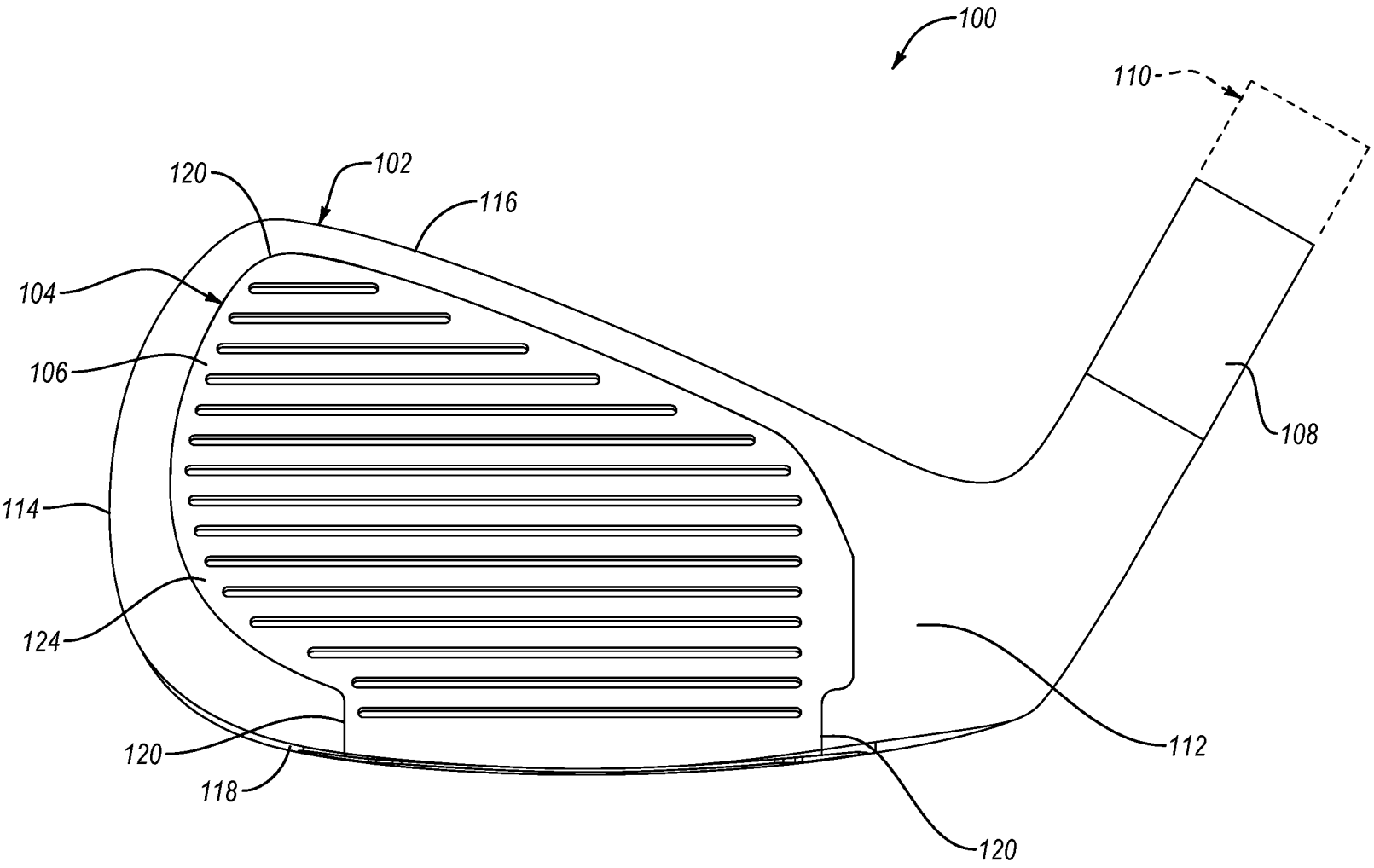
FIG. 5 is a front view of the golf club head of FIG. 4, according to one or more examples of the present disclosure.

In other configurations, the body 102 of the iron-type golf club head 100 has a multi-part construction. More specifically, the front portion 124, including the strike face 106, is formed separately from, and subsequently attached to, the toe portion 114, the heel portion 112, the top portion 116, the sole portion 118, and the rear portion 125. For example, as shown in FIGS. 4 and 5, the body 102 of the iron-type golf club head 100 includes a strike plate 104 welded to the rest of the body 102. The strike plate 104 includes at least a portion of a strike face 106. In some implementations, the strike plate 104 includes an entirety of the strike face 106. Generally, the strike plate 104 is defined as any piece of the golf club head 100 that is welded to a body 102 of the golf club head 100 and includes all or at least a portion of the strike face 106. In the illustrated embodiment, the strike plate 104 includes a sole wrap portion 122, which in some examples does not form part of the strike face 106.

Referring to FIG. 4, the strike plate 104 is formed separately from the other portions of the body 102 and is separately attached to the other portions of the body 102. The strike plate 104 and the other portions of the body 102 can be formed using the same type of process or different types of processes. In the illustrated embodiment, the other portions of the body 102 are formed to have a one-piece monolithic construction using a first manufacturing process and the strike plate 104 is formed to have a separate one-piece monolithic construction using a second manufacturing process. However, in other embodiments, one or both of the other portions of the body 102 and the strike plate 104 has a multiple-piece construction with each piece being made from the same or a different material. Additionally, the other portions of the body 102 can be formed of the same material as or a different material than the strike plate 104. The other portions of the body 102 are made from a first material and the strike plate 104 is made from a second material. Separately forming and attaching together the other portions of the body 102 and the strike plate 104 and making the other portions of the body 102 and the strike plate 104 from the same or different materials, which allows flexibility in the types of manufacturing processes and materials used, promotes the ability to make a golf club head 100 that achieves a wide range of performance, aesthetic, and economic results.

Referring still to FIGS. 4 and 5, the body 102 is configured to receive the portions of an outer peripheral edge 133 of the strike plate 104, to be welded to the body 102 via a peripheral weld 120, in seated engagement. More specifically, the body 102 includes a plate opening 176 defined between the toe portion 114, the heel portion 112, the top portion 116, and the sole portion 118 of the body 102. Generally, the plate opening 176 receives the strike plate 104 and helps to secure the strike plate 104 to the body 102. The plate opening 176 extends from a front side of the body 102 to a back side of the body 102. The body 102 additionally includes a plate interface 132 formed in the body 102 along at least a portion of the periphery of the plate opening 176. Generally, the plate interface 132 promotes attachment of the strike plate 104 to the body 102 by supporting the strike plate 104 against the body 102 and promoting the formation of a peripheral weld 120 between the strike plate 104 and the body 102. Accordingly, the plate interface 132 is formed along at least the portion or portions of the periphery of the plate opening 176 that will be welded to the strike plate 104.

In the illustrated embodiment of FIGS. 4 and 5, because the strike plate 104 is not welded to the body 102 at the sole portion 118 of the body 102, the plate interface 132 does not extend along the periphery of the plate opening 176 at the sole portion 118 of the body 102. However, in the illustrated embodiment of FIGS. 4 and 5, because the peripheral weld 120 is formed between the strike plate 104 and the body 102 continuously along the heel portion 112, the toe portion 114, and the top portion 116, the plate interface 132 is formed in and extends continuously along the portions of the periphery of the plate opening 176 at the heel portion 112, the toe portion 114, and the top portion 116.

The plate interface 132 includes a rim 136 and a ledge 138. The rim 136 defines a surface that faces an interior of the body 102 and the ledge 138 defines a surface that faces the front of the body 102. The rim 136 is transverse relative to the ledge 138. The rim 136 is sized to be substantially flush against or just off of the outer peripheral edge 133 of the strike plate 104. The fit between the rim 136 of the plate interface 132 and the outer peripheral edge 133 of the strike plate 104 facilitates the butt welding together of the rim 136 of the body 102 and the outer peripheral edge 133 of the strike plate 104 with the peripheral weld 120. In other words, the peripheral weld 120 is located between and welds together the rim 136 of the plate interface 132 and the outer peripheral edge 133 of the strike plate 104. As shown in FIG. 4, the rim 136 may extend beyond the plate interface 132, such as along the sole portion 118 of the body 102, to facilitate welding of the welded portions 134 of the outer peripheral edge 133 located on the sole wrap portion 122. More details regarding the iron-type golf club head 100 of FIGS. 4 and 5 can be found in U.S. patent application Ser. No. 15/706,632, filed Sep. 15, 2017, which is incorporated herein by reference. In other embodiments, the strike plate 104 is configured as an insert that is insertably coupled to the body 102, such as described in U.S. Pat. No. 9,033,819, issued May 19, 2015, which is incorporated herein by reference.

Although the strike face 106 is defined as the portion of the front portion 124 with grooves 107, it is recognized that in other examples, the strike face 106 may include portions of the front portion 124 that do not have grooves 107. For example, the strike face 106 of the iron-type golf club head 100 of FIGS. 1 and 2 could also include the portion of the front portion 124 between the toe portion 114 and the grooves 107 and/or the portion of the front portion 124 between the heel portion 112 and the grooves 107. However, because such locations on the front portion 124 are not intended to strike a golf ball during a proper impact with the golf ball, such locations are generally not considered forming part of the strike face 106.

The iron-type golf club head 100 of FIGS. 1-5 can be made of any of various materials. More specifically, the strike face 106 of the iron-type golf club head 100 of FIGS. 1-5 is made of any of various materials susceptible to oxidation. For example, in one implementation, the strike face 106, including or not including other portions of the body 102, is made of steel, such as carbon steel and other steel alloys. By way of non-limiting example, carbon steels may include 1015, 1018, 1020, 1025, 1030, and 1040. By way of non-limiting example, steel alloys may include 4130, 4140, 4150, 4340, 8620, 8630, and 8650 steel alloys. In some examples, the strike face 106 is made of a steel-nickel alloy with a percent composition of nickel less than about 4%. Other alloying elements producing inter-metallic precipitates in these steels include low percent compositions of chromium, cobalt, molybdenum, and titanium. In some examples, the strike face 106 is made of a steel-chromium alloy with a percent composition of chromium less than about 10%. According to yet other examples, the body 102, strike plate 104, and/or strike face 106 is made of a copper alloy (e.g., copper-beryllium alloy) or nickel alloy.

Figure 23:
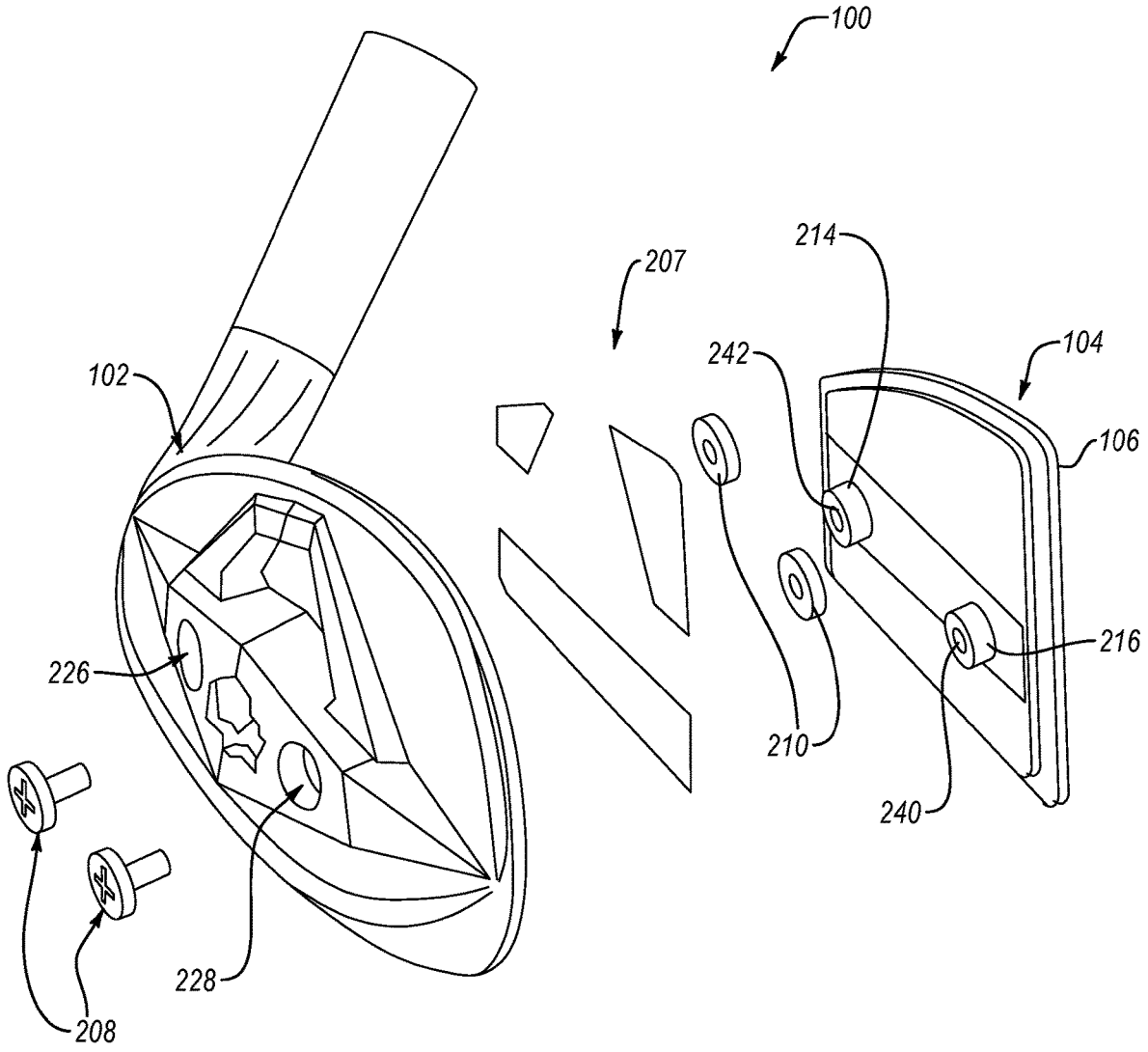
FIG. 23 is a perspective view of a golf club head with a strike plate that is selectively releasably coupleable to a body of the golf club head, according to one or more examples of the present disclosure.
Figure 24:
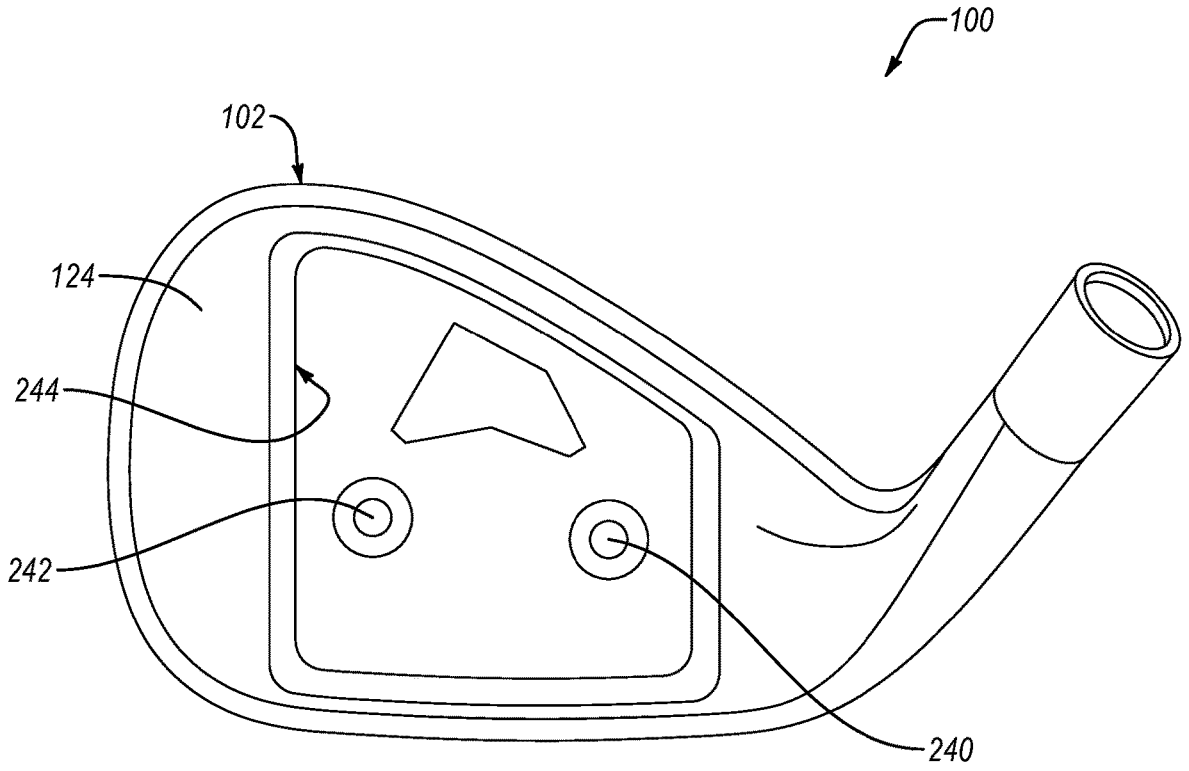
FIG. 24 is a front view of a golf club head of FIG. 23, shown without the strike plate selectively releasably coupled to the body of the golf club head, according to one or more examples of the present disclosure.

In some embodiments of a golf club head 100, as shown in FIGS. 23 and 24, the strike plate 104 can be configured to be selectively releasably coupled to the body 102 to enable exchangeable or interchangeable strike plates, such as described in U.S. Pat. No. 8,157,668, issued Apr. 17, 2012, which is incorporated herein by reference. For some examples, the strike plate 104 can be bolted, or otherwise releasably fastened, to the body 102. In the illustrated example of FIGS. 23 and 24, the strike plate 104 is bolted to the body 102 with bolts 208 and washers 210. The strike plate 104 may include threaded bores 240, 242 formed in bosses 240, 242. The threaded bores 240, 242 threadably receive the bolts 208 to selectively releasably couple the strike plate 104 to the body 102. The body 102 may include openings 226, 228 formed in the body 102 and through which the bolts 208 extend before threadably engaging the threaded bores 240, 242. Additionally, as shown in FIG. 24, the body 102 of the golf club head 100 includes a cavity 244 formed in a front portion of the golf club head 100. The cavity 244 nestably receives the strike plate 104. The golf club head 100 may further include an intermediate layer assembly 207 that acts as a gasket assembly to reduce the amount of potential rattle or unwanted sound between the strike plate 104 and the body 102.

For embodiments where the strike plate 104 is selectively releasably coupled to the body 102, the body 102 may be formed of carbon steel or steel alloys similar to the embodiments above and the strike plate 104 can be formed of an oxidizable material similar to those described above in relation to the strike face 106. An iron-type golf club head 100 having a selectively releasably coupled strike plate 104 would allow for either a raw or plated strike face 106 to be used with the golf club head 100 depending on user preference. Moreover, a manufacturer could make available for purchase individual strike plates 104 with a first oxidation-prevention coating 152 (as described below). When desirable (e.g., when the grooves are worn beyond a user's preference), the strike plate 104 on the golf club head 100 could be replaced with a new strike plate 104. The oxidation-prevention coating 152 would then be removed from the new strike plate 104, which would allow the new strike plate 104 to rust.

Additionally or alternatively, body 102 may be formed of material less prone to oxidation, such as stainless steels (17-4, 18-8), aluminum and aluminum alloys, titanium and titanium alloys. Polishing these materials may obtain the aesthetically pleasing semi to high gloss finish and would not necessarily require any protective coating or covering, e.g. plating to maintain this appearance as the golf club head is subjected to the elements. Additionally, an aluminum body may be anodized allowing for an array of color options, such as red, yellow, green, blue, purple, pink etc. Optionally a protective coating could be applied to a body made of these materials, but this is not required. Additionally or alternatively, body 102 may be formed of a material that is either dissimilar from or contrasts with the material used to form the strike plate 104, such as for example a body made from copper, bronze, or beryllium copper. A bronze or copper colored body, for example, may provide a contrast to a strike plate formed of steel thus framing and/or highlighting the striking area.

In some examples, the strike face 106 is machined (e.g., milled). In some implementation, milling the strike face 106 helps to improve performance of the iron-type golf club head 100, such as increasing the spin of a golf ball struck by the strike face 106, by introducing grind patterns in the strike face 106. The grooves 107 can be machined into the strike face 106 using the same or similar techniques. Machining the grooves 107 promotes precision and sharpness of the edges of the grooves 107, which in turn improves the spin performance of the iron-type golf club head 100. The strike face 106 can be milled using the techniques disclosed in U.S. patent application Ser. No. 15/853,774, filed Dec. 23, 2017, which is incorporated herein by reference. Additionally, because the strike face 106 is not coated with a permanent coating, as described below and which may result in less precise edges of the grooves 107, the precision of the edges of the grooves 107 can be more closely aligned with more precise tolerances.

Whether milled, cast, or forged, the strike face 106 of the golf club head 100 is sand blasted, or blasted using another abrasive blasting technique, in some examples. Further still, according to certain examples, the strike face 106 can be texturized using laser etching or electrical discharge machining (EDM) techniques.

Figure 9:
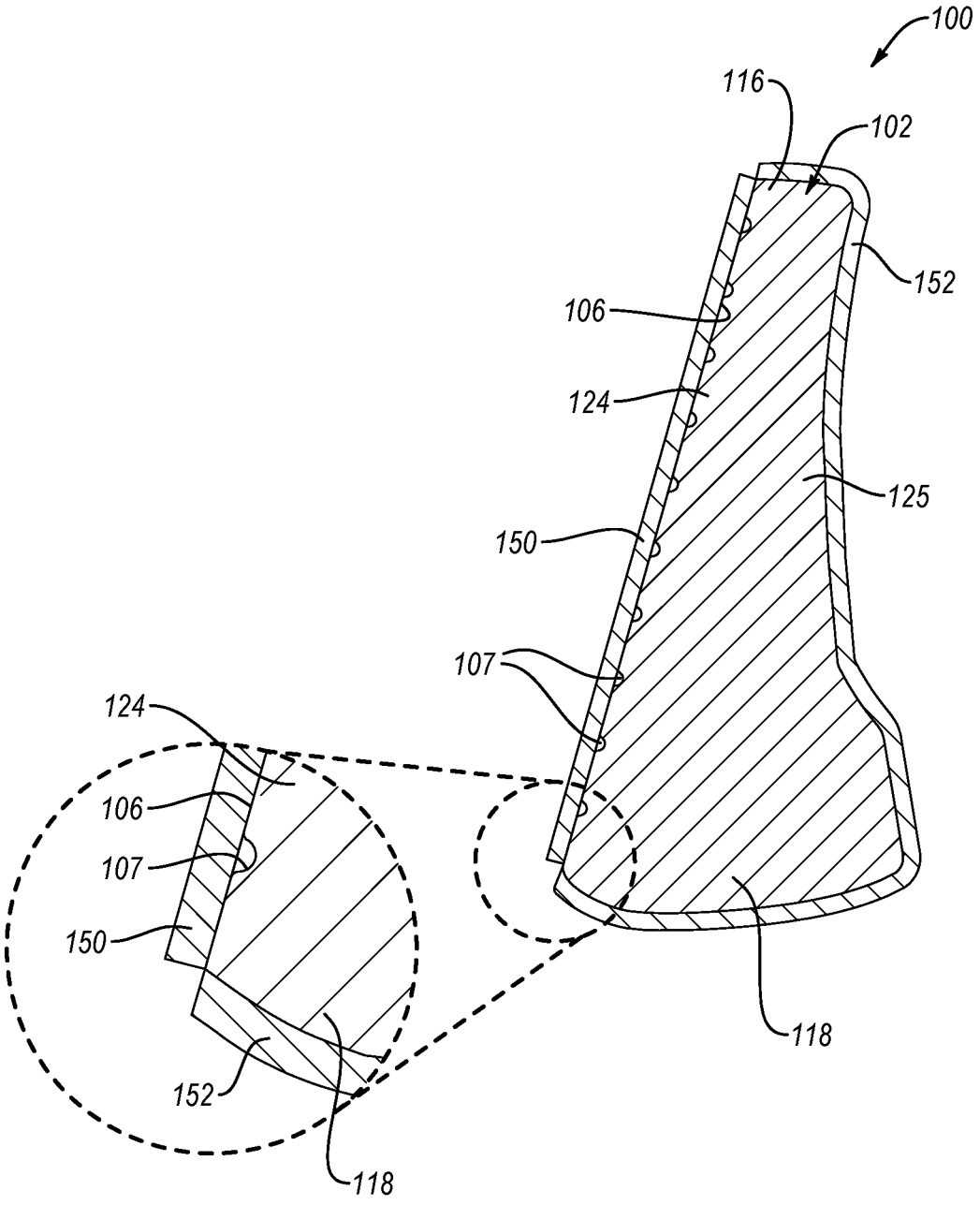
FIG. 9 is a cross-sectional side elevation view and a detailed view from a heel side of the golf club head of FIG. 1, taken along the line 9-9 of FIG. 2, according to one or more examples of the present disclosure.

In some embodiments, select portions of the iron-type golf-club head 100 of the present disclosure further includes a first oxidation-prevention coating 152 that permanently covers the inner surface of the select portions of the body 102 and does not cover all or part of the outer surface of at least one portion of the strike face 106. As defined herein, a coating covers a surface by directly or indirectly contacting the surface. According to some examples, as shown in FIGS. 1 and 9, the first oxidation-prevention coating 152 permanently covers the inner surface of only the heel portion 112, the sole portion 118, the toe portion 114, the rear portion 125, and at most a limited part of the front portion 124. In the example of FIGS. 1 and 9, the limited part of the front portion 124 can be the part of the front portion 124 that does not include the strike face 106. In other words, in one example, the first oxidation-prevention coating 152 does not cover any part of the strike face 106, but may cover the inner surface of other parts of the front portion 124. According to another example, however, the limited part of the front portion 124 can include a part (e.g., less than an entirety) of the strike face 106. In some implementations, the first oxidation-prevention coating 152 includes multiple coats or layers of material, such as two coats of a nickel-chromium coating.

The first oxidation-prevention coating 152 is considered to permanently cover select portions of the inner surface of the body 102 because the first oxidation-prevention coating 152 cannot be easily removed from the inner surface of the select portions of the body 102 without damaging the select portions of the body 102. In other words, in some examples, the first oxidation-prevention coating 152 is permanently bonded or sealed to the inner surface of the select portions of the body 102. In one example, the first oxidation-prevention coating 152 is a metallic plating permanently bonded to the inner surface of the select portions of the body 102. Although the word permanent is used to describe the coating, the first oxidation-prevention coating may over time wear, chip, flake, or degrade as is common for coatings of this nature. For example, repeated jostling against and banging into other clubs may cause a plating to be damaged allowing for oxidation of the underlying surface. As noted, the inner surface of the select portions of the body 102 covered by the first oxidation-prevention coating 152 is initially an outer surface until coated, at which time the outer surface becomes an inner surface and the first oxidation-prevention coating 152 defines the outer surface of the select portions. Accordingly, when not permanently covered by the first oxidation-prevention coating 152, the outer surface of the uncovered portions remain the outer surface of those portions of the golf club head 100.

In some embodiments, a ratio of the surface area of the body 102 not permanently covered by the first oxidation-prevention coating 152 to the total surface area of the body 102 is greater than zero. In other words, some portion of the total surface area of the body 102 of the golf club head 100 is not covered by the first oxidation-prevention coating 152. In specific examples, which can be associated with wedge-type golf club heads e.g. golf club heads having a loft of about 45 degrees or more, the ratio of the surface area of the body 102 not permanently covered by the first oxidation-prevention coating 152 to the total surface area of the body 102 is at least 0.25, such as between 0.25 and 0.4, inclusive. According to one example, which can be associated with wedge-type golf club heads, the ratio of the surface area of the body 102, without the hosel 108 (see below), not permanently covered by the first oxidation-prevention coating 152 to the total surface area of the body 102 is between 0.27 and 0.39, inclusive. In an example where the total surface area of the body 102 is about 9,292 $mm^2$, the ratio is about 0.39. In an example where the grooves 107 extend to the toeward end of the strike face 106 (see, e.g., FIG. 3) and the total surface area of the body 102 is about 8,958 $mm^2$, the ratio is about 0.37. In another example where the grooves 107 do not extend to the toeward end of the strike face 106 (see, e.g., FIG. 2) and the total surface area of the body 102 is about 8,958 $mm^2$, the ratio is about 0.27.

In other specific examples, which can be associated with a set of golf clubs e.g. 2 iron thru PW (17 degrees to 48 degrees), and/or low-lofted (e.g. 17 degrees to 28 degrees) or mid-lofted (29 degrees to 44 degrees) iron-type golf club heads, the ratio of the surface area of the body 102 not permanently covered by the first oxidation-prevention coating 152 to the total surface area of the body 102 is at least 0.23, such as between 0.23 and 0.3, inclusive. According to one example, which can be associated with low-lofted or mid-lofted iron-type golf club heads, the ratio of the surface area of the body 102 not permanently covered by the first oxidation-prevention coating 152 to the total surface area of the body 102 is between 0.27 and 0.30, inclusive. In another example, which can be associated with low-lofted or mid-lofted iron-type golf club heads, the ratio of the surface area of the body 102 not permanently covered by the first oxidation-prevention coating 152 to the total surface area of the body 102 is between 0.23 and 0.27, inclusive. In an example where the total surface area of the body 102 is about 7,235 $mm^2$, the ratio is about 0.27. In an example where the total surface area of the body 102 is about 7,747 $mm^2$, the ratio is about 0.28. In an example where the total surface area of the body 102 is about 8,126 $mm^2$, the ratio is about 0.3. In an example where the total surface area of the body 102 is about 8,433 $mm^2$, the ratio is about 0.24. In an example where the total surface area of the body 102 is about 8,805 $mm^2$, the ratio is about 0.26.

The total surface area of the body 102, for purposes of determining the surface area ratios defined herein, is the total surface area of the body 102 excluding the hosel 108 and excluding the entire portion of the body 102 heelward of the par line of the golf club head 100. Moreover, the total surface area of the body 102 does not include the cross-sectional area of the golf club head 100 at the par line. As further defined, the total surface area of the body 102 of the golf club head 100 does not include the surface area of the grooves 107. In other words, the total surface area of the body 102 of the golf club head 100 assumes a strike face 106 that is grooveless.

In some embodiments, a ratio of the surface area of the strike face 106 not permanently covered by the first oxidation-prevention coating 152 to the total surface area of the strike face 106 is greater than zero. In other words, some portion of the total surface area of the strike face 106 of the golf club head 100 is not covered by the first oxidation-prevention coating 152.

In specific examples, which can be associated with wedge-type golf club heads e.g. golf club heads having a loft of about 45 degrees or more, the ratio of the surface area of the strike face 106 not permanently covered by the first oxidation-prevention coating 152 to the total surface area of strike face 106 is at least 0.70, such as between 0.74 and 1.0, inclusive.

In other specific examples, which can be associated with a set of golf clubs e.g. 2 iron thru PW (17 degrees to 48 degrees), and/or low-lofted (e.g. 17 degrees to 28 degrees) or mid-lofted (29 degrees to 44 degrees) iron-type golf club heads, the ratio of the surface area of the strike face 106 not permanently covered by the first oxidation-prevention coating 152 to the total surface area of the strike face 106 is at least 0.70, such as between 0.75 and 1.00, inclusive, between 0.75 and 0.81, inclusive, or between 0.75 and 0.76, inclusive.

In some embodiments, a value of the surface area of the strike face 106 not permanently covered by the first oxidation-prevention coating 152 divided by the total volume of the body 102, is at least 0.05 per mm, such as between 0.055 and 0.12 per mm, inclusive. In specific examples, which can be associated with wedge-type golf club heads, the value of the surface area of the strike face 106 not permanently covered by the first oxidation-prevention coating 152 divided by the total volume of the body 102 is between 0.08 and 0.12 per mm, inclusive. In other specific examples, which can be associated with low-lofted or mid-lofted iron-type golf club heads, the value of the surface area of the strike face 106 not permanently covered by the first oxidation-prevention coating 152 divided by the total volume of the body 102 is between 0.05 and 0.086 per mm, inclusive, 0.084 and 0.086 per mm, inclusive, or between 0.05 and 0.07 per mm, inclusive.

The total volume of the body 102 of the golf club head 100 can be measured using a water-displacement method. For example, the body 102 of the golf club head 100 may be submerged toe-end first until the water level reaches the par line with club head being in an orientation such that the par line is substantially horizontal, alternatively the score-lines or grooves may be substantially vertical in this orientation. As used herein, values for the total volume and the surface area of the body 102 include only that portion of the body 102 of the golf club head 100 that is toeward of the par line 188. In other words, when referenced herein, the total volume or surface area of the body 102 (or portions of the body) does not include any portion of the body 102 heelward of the par line 188 (shown in FIG. 1). Accordingly, any measurements of the total volume or surface area of the body 102 are determined after the hosel 108 is removed from the body 102 at the par line 188. For volumetric measurements, the body 102, with the hosel 108 removed, would be submersed and suspended into water (e.g. a string or fishing line may be attached to the object to suspend the object in the water). The measured displacement of the water caused by submersion of the body 102 is equal to the total volume of the body 102. Any apertures or holes in the body 102 open to an interior of the body 102 can be sealed (e.g., taped over) prior to submersing the body 102 into the water. For determining the total volume of the body 102, the grooves 107 can be included or not included in strike face 106.

The first oxidation-prevention coating 152 prevents or reduces oxidation (e.g., the formation of rust) on the inner or underlying surfaces of the select portions of the body 102. Because the first oxidation-prevention coating 152 forms a permanent seal against the underlying surfaces of the select portions of the body 102, oxygen is permanently prevented from contacting the underlying surfaces, thus permanently preventing oxidation of underlying surfaces.

Additionally, in some examples, the first oxidation-prevention coating 152 is made of a material that is resistant to oxidation. In other words, despite being exposed to air, the first oxidation-prevention coating 152 does not oxidize in some examples. For example, the first oxidation-prevention coating 152 may be made of oxidation-resistant materials, such as chromium (e.g., CrN, CrCN, etc.), stainless steel, nickel, zirconium (e.g., ZrN, ZrCN, etc.), titanium (e.g., TiN, TiCN, TiZrN, etc.), and paint.

However, in other examples, the first oxidation-prevention coating 152 is made of a material that may exhibit some oxidation. In a specific example, the first oxidation-prevention coating 152 experiences oxidation at a lower rate than that of the surface of the striking face 106 uncovered by the first oxidation-prevention coating 152. According to certain examples, the first oxidation-prevention coating 152 can be made from any of various low oxidation materials, such as copper and bronze.

The iron-type golf-club head 100 of the present disclosure further includes a second oxidation-prevention coating 150 that non-permanently covers at least some (e.g., all or select portions) of the strike face 106 not covered by the first oxidation-prevention coating 152. In one example, the second oxidation-prevention coating 150 does not non-permanently cover any portions of the body 102 permanently covered by the first oxidation-prevention coating 152. However, in other examples, the second oxidation-prevention coating 150 non-permanently covers (e.g., wraps around) at least part of at least one portion of the body 102 that is permanently covered by the first oxidation-prevention coating 152. For example, the second oxidation-prevention coating 150 can cover all or part of the top portion 116 of the golf club head 100 and/or all or part of the sole portion 118 of the golf club head 100. In other words, the second oxidation-prevention coating 150 covers portions of the golf club head 100, other than the front portion 124, in certain examples. In some examples, a total area of the second oxidation-prevention coating 150 is at least 5% greater than, at least 7% greater than, at least 9% greater than, at least 11% greater than, at least 13% greater than, at least 15% greater than, at least 18% greater than, or at least 21% greater than a total area of the oxidizable strike face 106. The total area of the second oxidation-prevention coating 150 is 2,950 mm^2 and the total area of the oxidizable strike face 106 is 2,500 mm^2 in certain examples.

In some examples, a width of the second oxidation-prevention coating 150, in a heel-toe direction, is at least as wide as (e.g., at least 5% greater than, at least 7% greater than, at least 9% greater than, at least 11% greater than, at least 13% greater than, or at least 15% greater than) a heel-toe width of the oxidizable strike face 106. This helps ensure sufficient coverage and protection of the raw area, on the heel side and the toe side, prior to the user removing the sticker and makes placement of the sticker easier in manufacturing. The width of the second oxidation-prevention coating 150 is 56.5 mm and the width of the oxidizable strike face 106 is 52 mm in certain examples.

some examples, a length of the second oxidation-prevention coating 150, in a sole-top direction, is at least as long as (e.g., at least 5% greater than, at least 7% greater than, at least 9% greater than, at least 11% greater than, at least 13% greater than, or at least 15% greater than) a sole-top length of the oxidizable strike face 106. This helps ensure sufficient coverage and protection of the raw area, on the sole side and the top side, prior to the user removing the sticker and makes placement of the sticker easier in manufacturing. The length of the second oxidation-prevention coating 150 is 64.5 mm and the length of the oxidizable strike face 106 is 59.5 mm in certain examples. According to an example, the second oxidation-prevention coating 150 has a length that is at least 12% greater than the length of the oxidizable strike face 106 and has a width that is at least 12% greater than the width of the oxidizable strike face 106.

According to some examples, as shown in FIGS. 6-10, the second oxidation-prevention coating 150 non-permanently covers an entirety of the strike face 106. For example, referring to FIG. 6, in certain examples, the second oxidation-prevention coating 150 non-permanently covers an entirety of the strike face 106 (e.g., the portion of the front portion 124 within a scoreline area) but does not cover an entirety of the front portion 124.

In contrast, in some examples shown in FIGS. 11-18, the second oxidation-prevention coating 150 non-permanently covers only a limited part of the strike face 106 not covered by the first oxidation-prevention coating 152. In other words, part of the strike face 106 not covered by the first oxidation-prevention coating 152 and not covered by the second oxidation-prevention coating 150 is exposed to air, and thus susceptible to oxidation. According to certain implementations, a ratio of the portion of the strike face 106 covered by the second oxidation-prevention coating 150 to the portion of the strike face 106 not covered by the first oxidation-prevention coating 152 and not covered by the second oxidation-prevention coating 150 is between 0.1 and 1.0. In one example, the ratio is 1.0. In another example, the ratio is equal to or greater than 0.5 and less than 1.0.

Figure 11:
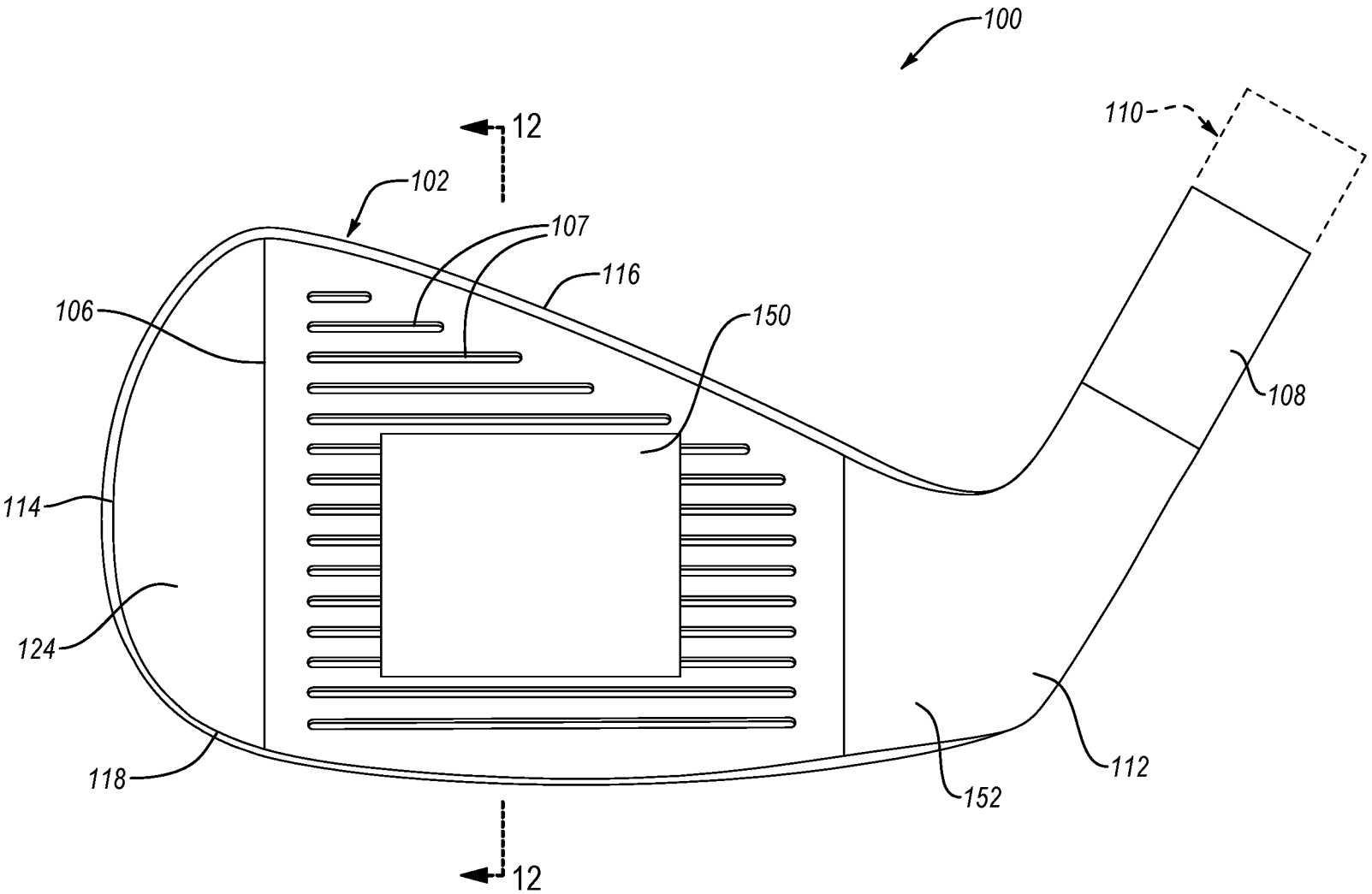
FIG. 11 is a front view of the golf club head of FIG. 1, shown with an oxidation-prevention coating non-permanently covering a strike face of the golf club head, according to one or more examples of the present disclosure.
Figure 12:
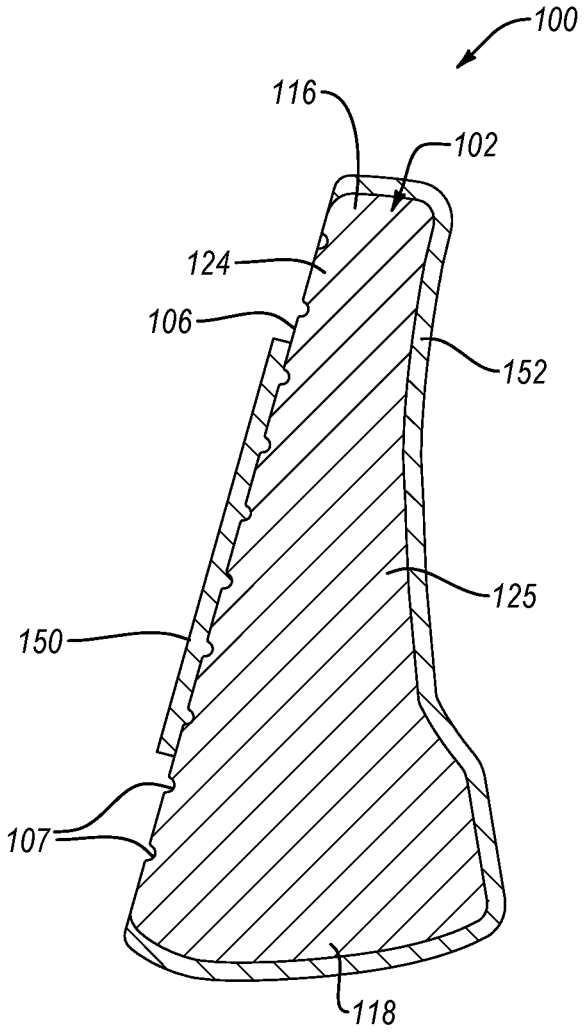
FIG. 12 is a cross-sectional side elevation view from a heel side of the golf club head of FIG. 11, taken along the line 12-12 of FIG. 11, according to one or more examples of the present disclosure.

In FIG. 11, the second oxidation-prevention coating 150 has a basic shape (e.g., square, trapezoidal, circular, etc.) and thus the limited part of the strike face 106 non-permanently covered by the second oxidation-prevention coating 150 also has a basic shape. Alternatively, in FIGS. 13-18, the second oxidation-prevention coating 150 has a non-basic shape, corresponding with indicia, and thus the limited part of the strike face 106 non-permanently covered by the second oxidation-prevention coating 150 also has a non-basic shape corresponding with indicia. According to some examples, the indicia is at least one of performance indicia, information indicia, or cosmetic indicia.

Figure 13:
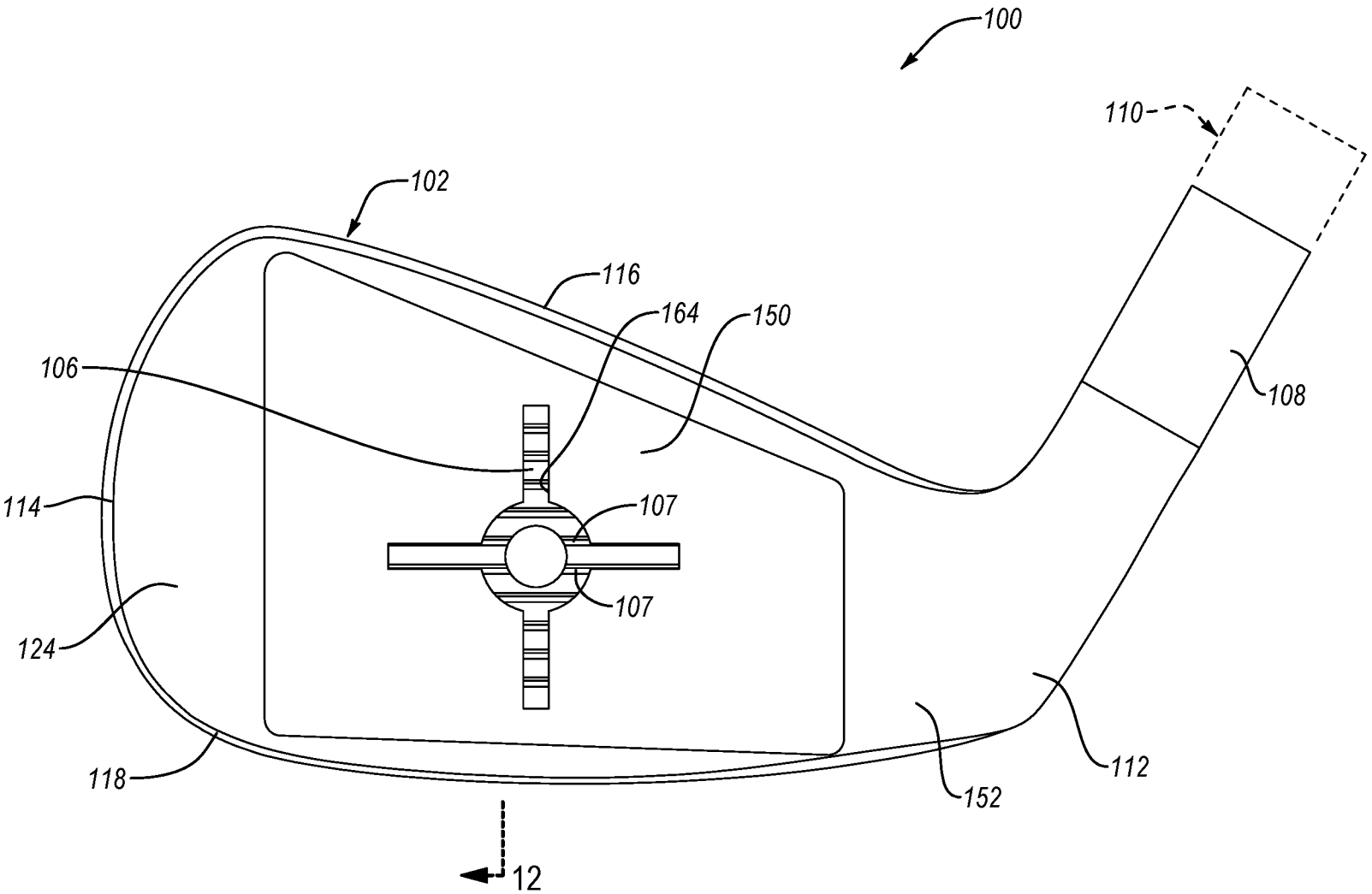
FIG. 13 is a front view of the golf club head of FIG. 1, shown with an oxidation-prevention coating non-permanently covering a strike face of the golf club head, according to one or more examples of the present disclosure.
Figure 16:
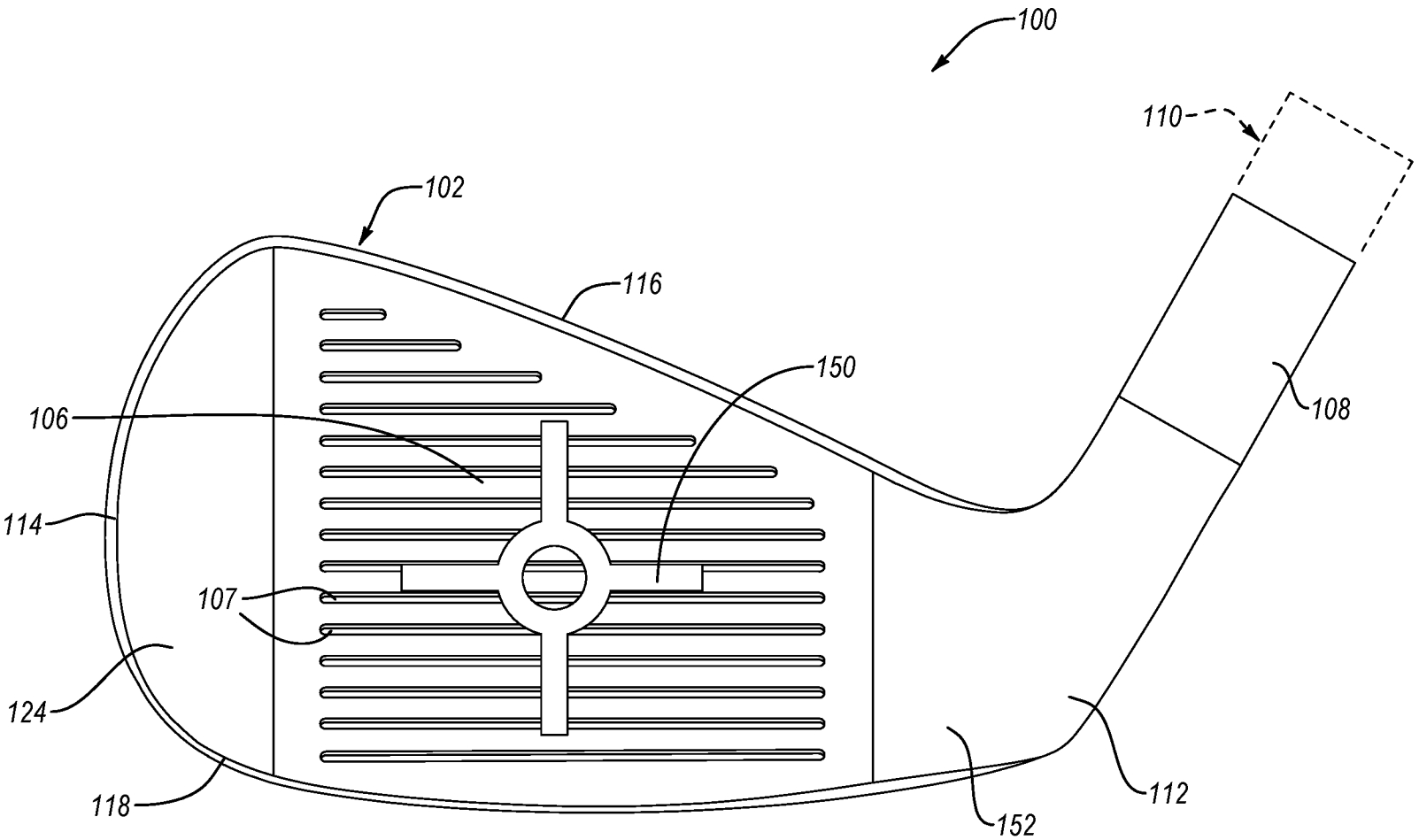
FIG. 16 is a front view of the golf club head of FIG. 1, shown with an oxidation-prevention coating non-permanently covering a strike face of the golf club head, according to one or more examples of the present disclosure.

Referring to FIGS. 13 and 16, one example of the second oxidation-prevention coating 150 having a shape corresponding with performance indicia is shown. Performance indicia is defined as indicia that promotes performance of the iron-type golf club head 100 in striking a golf ball. The performance indicia in the illustrated example includes center face indicia identifying the center of the strike face 106, which is associated with an ideal impact location, and includes alignment indicia to help promote proper alignment of the iron-type golf club head 100 when addressing a golf ball. The center face indicia is shown as a circle and the alignment indicia is shown as heel-to-toe lines and bottom-to-top lines extending from the circle. Although one type of performance indicia is shown, in other examples, the second oxidation-prevention coating 150 can have a shape corresponding with other types of performance indicia.

Figure 14:
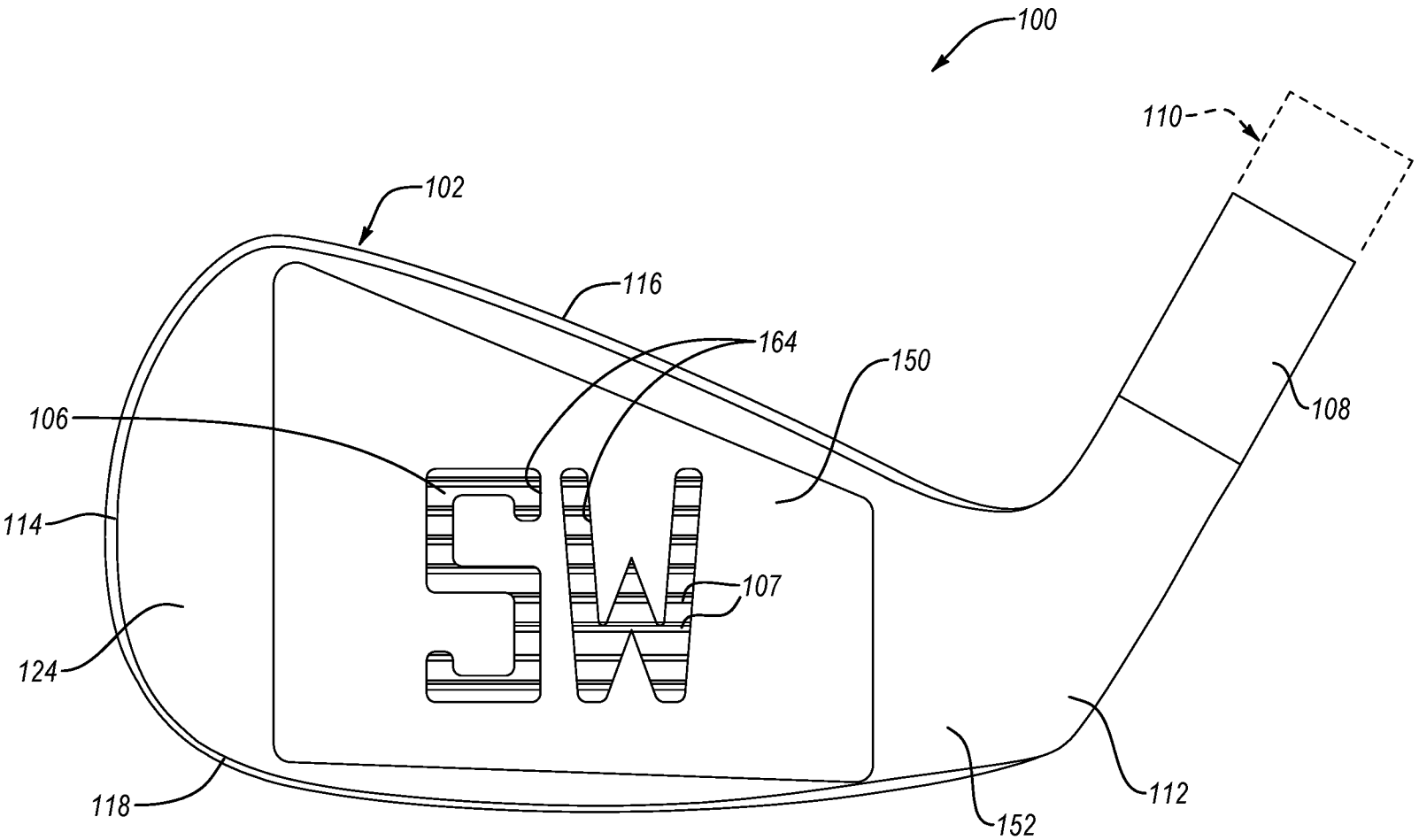
FIG. 14 is a front view of the golf club head of FIG. 1, shown with an oxidation-prevention coating non-permanently covering a strike face of the golf club head, according to one or more examples of the present disclosure.
Figure 17:
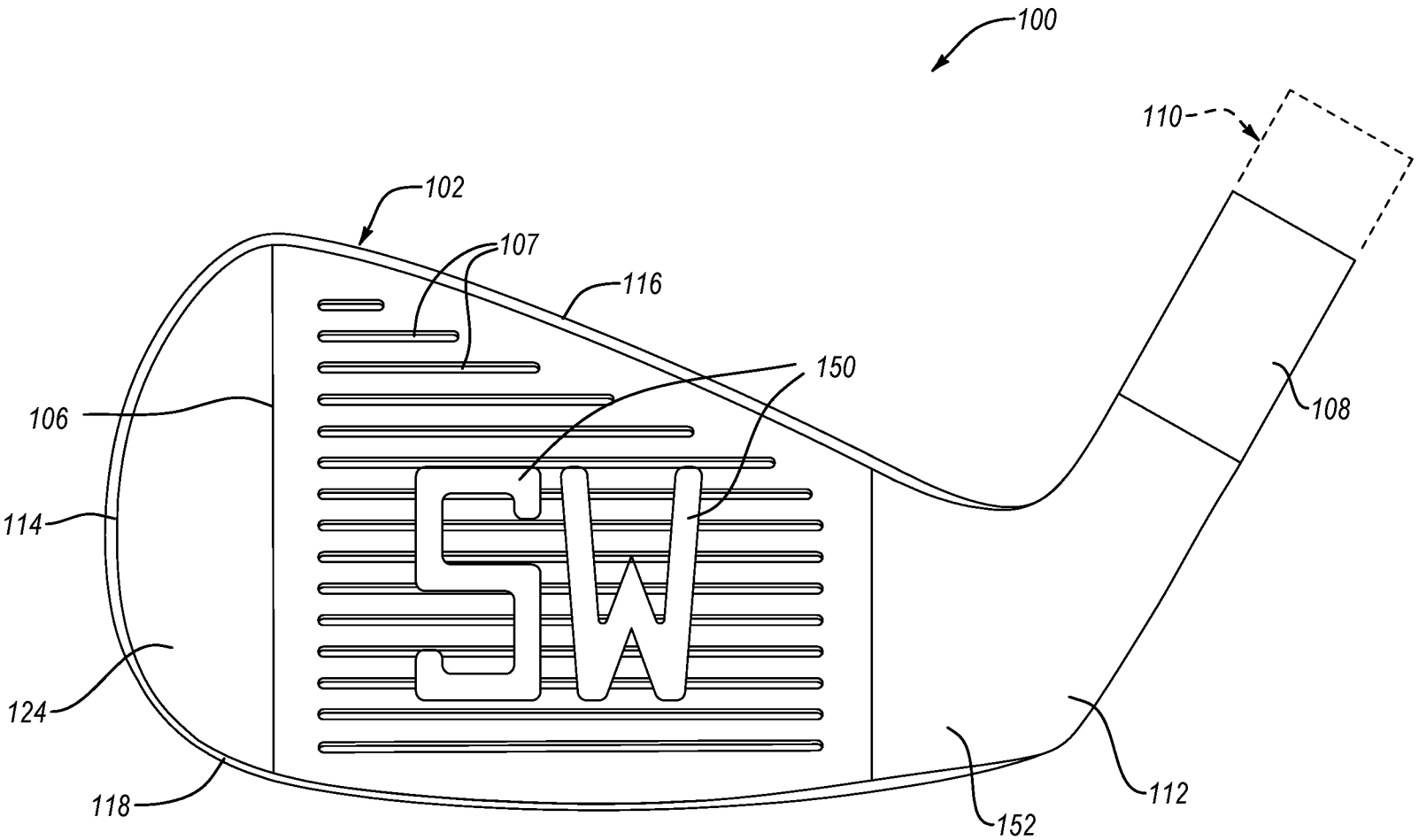
FIG. 17 is a front view of the golf club head of FIG. 1, shown with an oxidation-prevention coating non-permanently covering a strike face of the golf club head, according to one or more examples of the present disclosure.

Referring to FIGS. 14 and 17, one example of the second oxidation-prevention coating 150 having a shape corresponding with informational indicia is shown. Informational indicia is defined as indicia that provides information regarding the characteristics of the iron-type golf club head 100. The informational indicia in the illustrated example includes club identification indicia identifying the club. In one example, as shown, the club identification indicia identifies the club by a number or letter(s) of the club (e.g., SW, PW, 9, 8, 7, 6, 5, 4, 3, etc.). In another example, the club identification indication identifies the club by a loft of the club (e.g., 60°, 56°, 52°, etc.). Although one type of identification indicia is shown, in other examples, the second oxidation-prevention coating 150 can have a shape corresponding with other types of identification indicia, such as the lie indicia, bounce indicia, etc. Another example of information indicia may include messages or tips to an end user. It is noted that the indicia provided by the second oxidation-prevention coating 150 can be factory-governed or customizable by an end user of the golf club head 100.

Figure 15:
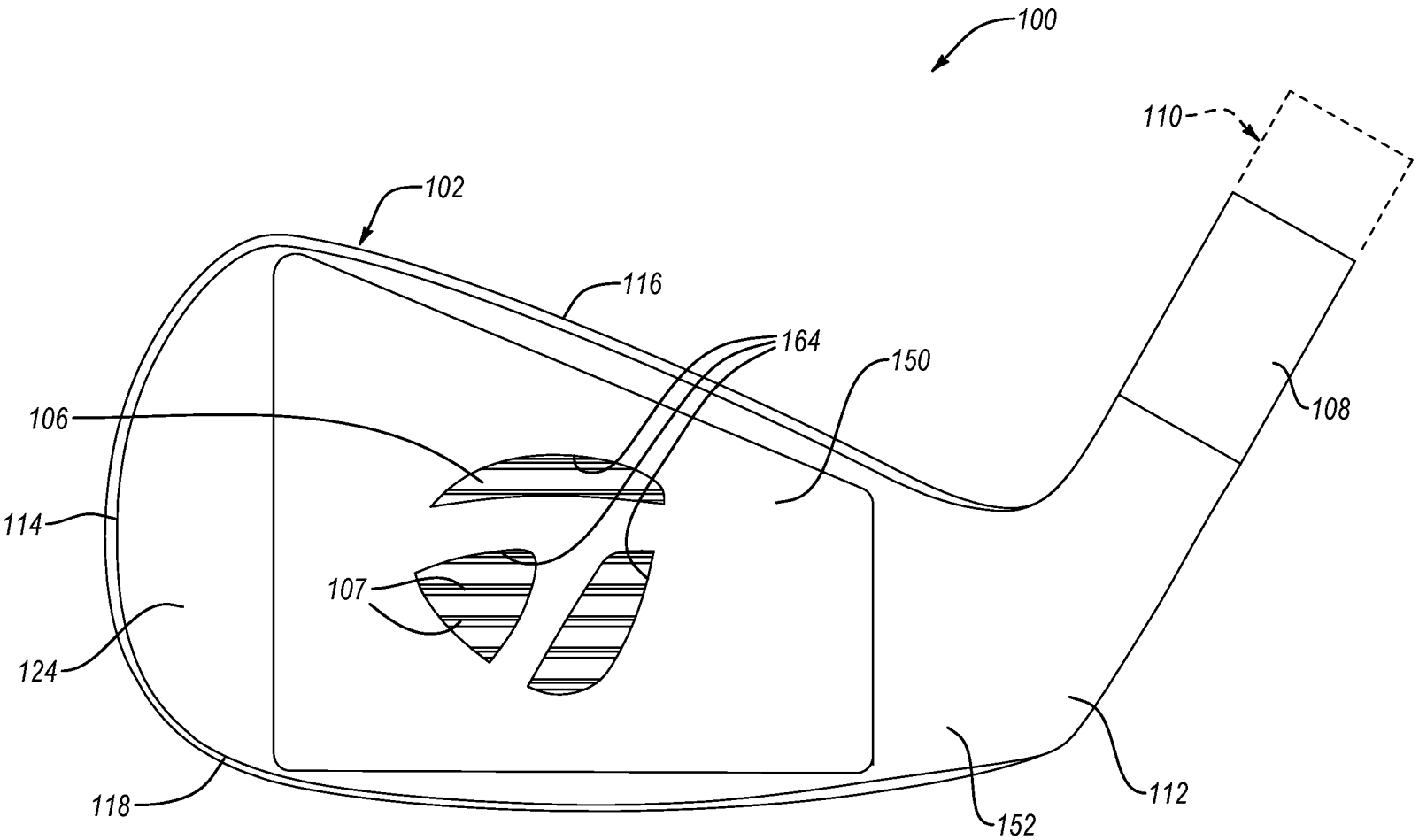
FIG. 15 is a front view of the golf club head of FIG. 1, shown with an oxidation-prevention coating non-permanently covering a strike face of the golf club head, according to one or more examples of the present disclosure.
Figure 18:
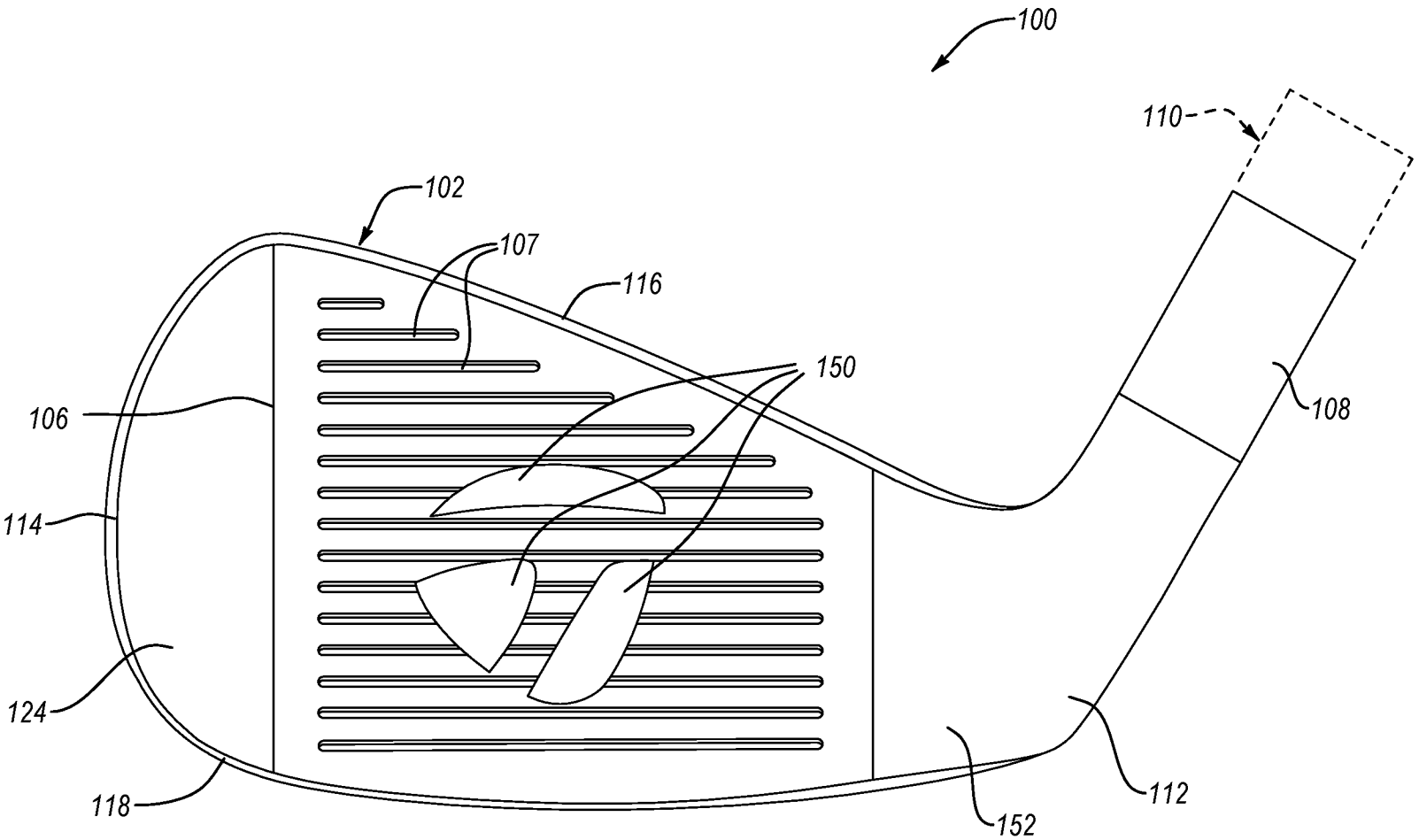
FIG. 18 is a front view of the golf club head of FIG. 1, shown with an oxidation-prevention coating non-permanently covering a strike face of the golf club head, according to one or more examples of the present disclosure.

Referring to FIGS. 15 and 18, one example of the second oxidation-prevention coating 150 having a shape corresponding with cosmetic indicia is shown. Cosmetic indicia are defined as indicia that promotes the cosmetic look and feel of the iron-type golf club head 100. The cosmetic indicia in the illustrated example includes manufacturer identification indicia identifying the manufacturer of the club. In the example shown, the cosmetic indicium is the logo of the manufacturer of the club. In another example, not shown, the cosmetic indicium identifies the owner of the club, such as by including the initials of the owner of the club. Although a couple types of cosmetic indicia are shown and described, in other examples, the second oxidation-prevention coating 150 can have a shape corresponding with other types of cosmetic indicia, such as promotional indicia, club membership indicia, organization indicia, and the like.

The second oxidation-prevention coating 150 is considered to non-permanently cover at least some of the strike face 106 because the second oxidation-prevention coating 150 can be removed from the strike face 106 without damaging the strike face 106. In other words, in some examples, the second oxidation-prevention coating 150 is non-permanently sealed to the strike face 106. The second oxidation-prevention coating 150 can be further defined as a user-removable coating, a removable-by-design coating, or an intended-to-be-removed coating because the second oxidation-prevention coating 150 is configured to be selectively removable from the strike face 106 by an end user of the iron-type golf club head 100.

Additionally, the second oxidation-prevention coating 150 prevents or reduces oxidation (e.g., the formation of rust) on the underlying portion of the strike face 106. Because the second oxidation-prevention coating 152 forms a temporary seal against the underlying portion of the strike face 106, oxygen is temporarily prevented from contacting the underlying surfaces, thus temporarily preventing oxidation of the underlying portion of the strike face 106 until the second oxidation-prevention coating 150 is removed. This allows an end-user to control when oxidation of the strike face 106 begins. Additionally, because a surface roughness of a golf club head is allowed to exceed minimum roughness standards if such roughness was caused by normal use of the club by an end-user, the second oxidation-prevention coating 150 also ensures a surface roughness of the strike face 106 conforms to regulated standards when the golf club head 100 is distributed to an end-user. Therefore, the second oxidation-prevention coating 150 can be made of a material and have a configuration that facilitates both prevention of oxidation and the user-removability. In some examples, the second oxidation-prevention coating 150 is made of a non-metallic material.

In one example, the second oxidation-prevention coating 150 is a sticker or tape. Each of the sticker or tape can have a fibrous, polymeric (e.g., vinyl), or metal substrate or sheet (backing material) backed by an adhesive layer. The adhesive layer, when pressed against the strike face 106, temporarily bonds or seals the substrate to the strike face 106 to temporarily prevent oxidation of the strike face 106. Furthermore, the adhesive layer is removed or debonded from the strike face 106 by removing (e.g., peeling) the adhesive layer away from the strike face 106. The adhesive layer can be made of any of various organic or inorganic adhesive materials, such as a rubber-based adhesive, glue, paste, and the like. In some examples, the second oxidation-prevention coating 150 has an adhesion strength of within 0.15 and 1.35 of 26 oz/in (280 N/m), within 0.85 and 1.15 of 26 oz/in, or within 0.95 and 1.05 of 26 oz/in. In certain examples, the second oxidation-prevention coating 150 has a percent elongation between 110% and 170%, between 120% and 140%, or 130%. Additionally, the second oxidation-prevention coating 150 is weather-resistant and UV-resistant, and does not leave a residue behind on the surface to which the second oxidation-prevention coating 150 was adhered, in some examples. According to one example, the second oxidation-prevention coating 150 is made of a vinyl tape, such as Vinyl Tape 471, made by 3M™. According to yet another example, the second oxidation-prevention coating 150 is made of a removable label, such as one with a polypropylene backing and acrylic adhesive (e.g., Removable Label Materials FP0862, made by 3M™), which can have additional information printed thereon. In certain examples, the second oxidation-prevention coating 150 has an adhesion strength of about 53 N/m).

Figure 6:
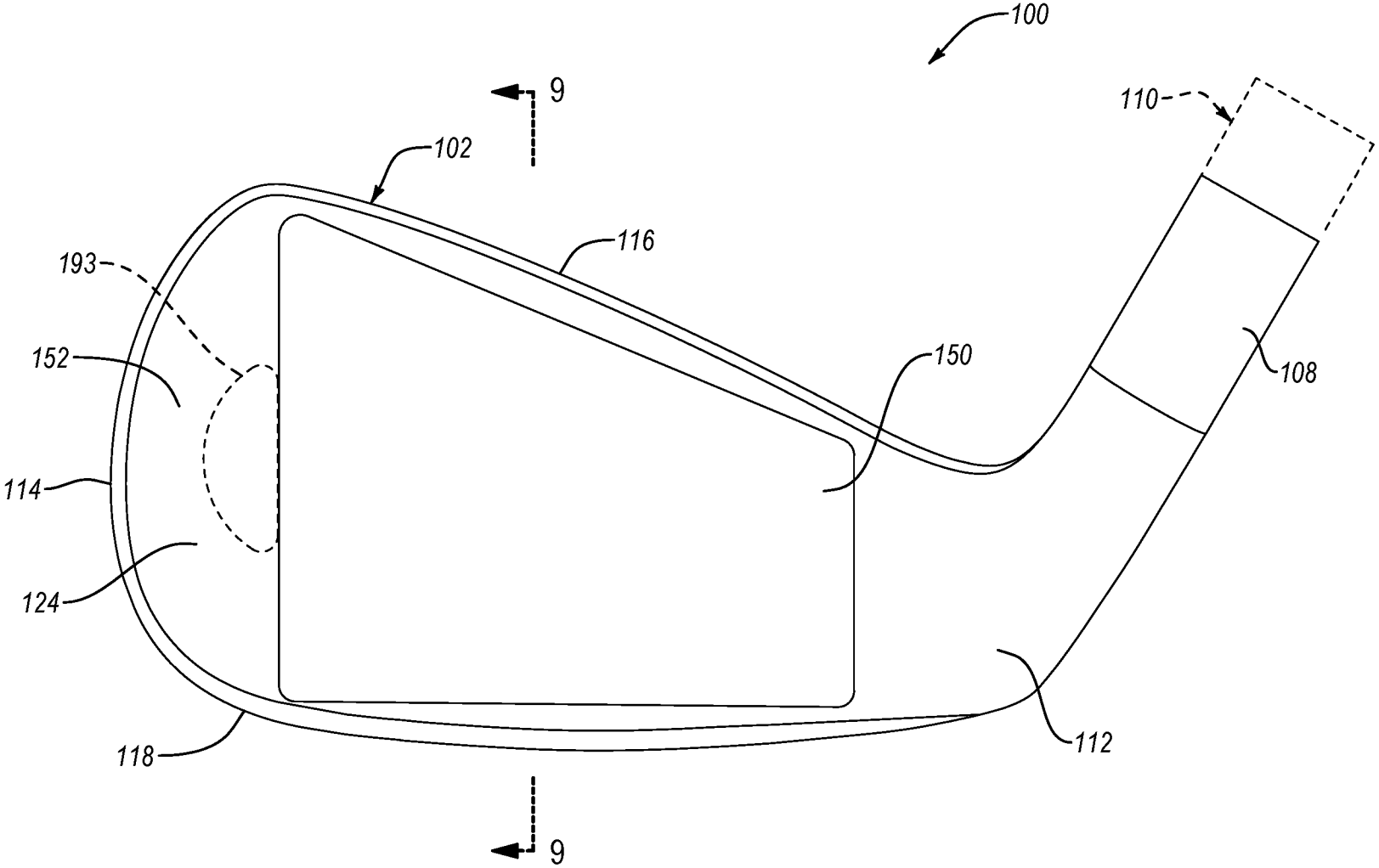
FIG. 6 is a front view of the golf club head of FIG. 1, shown with an oxidation-prevention coating non-permanently covering a strike face of the golf club head, according to one or more examples of the present disclosure.
Figure 7:
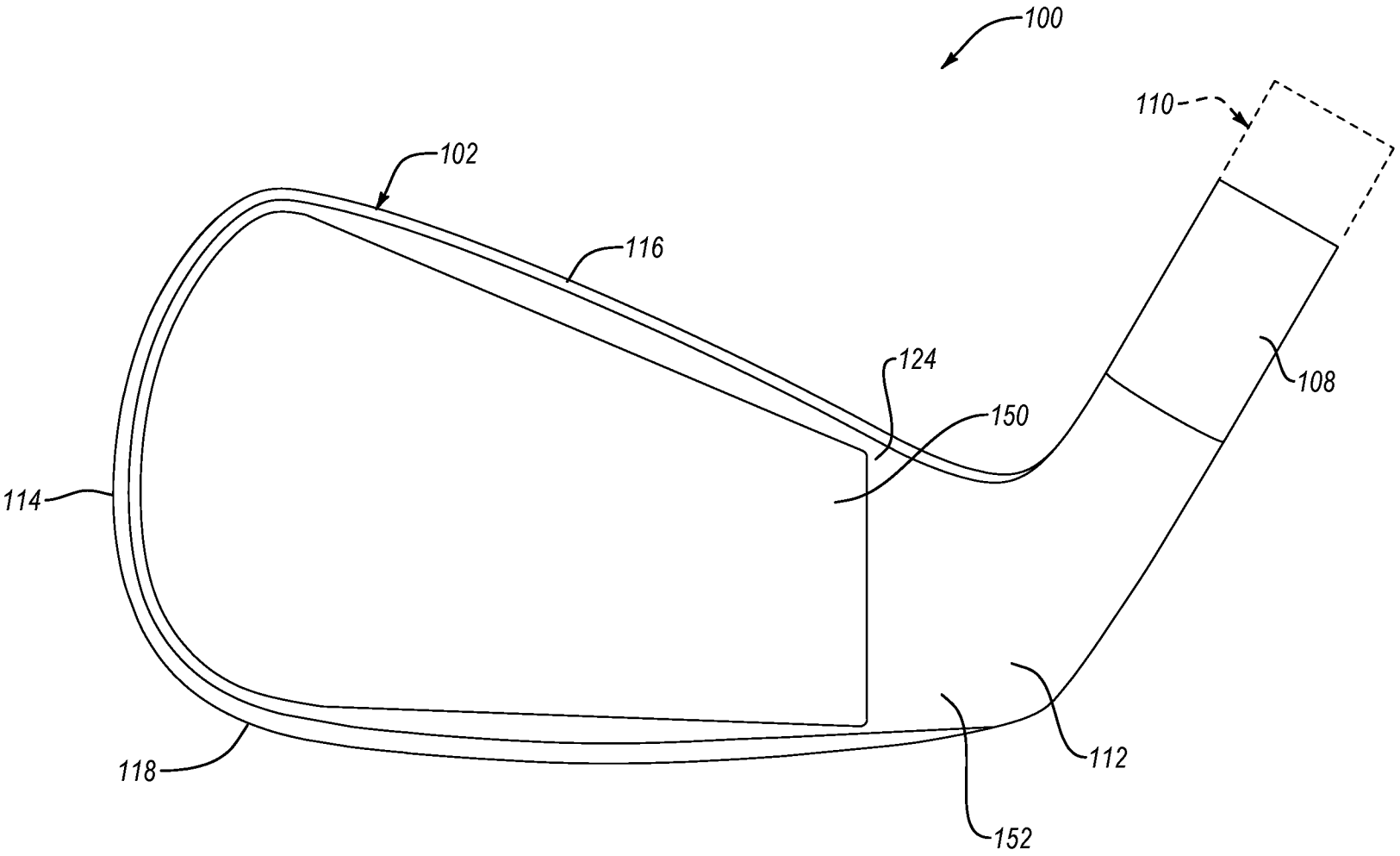
FIG. 7 is a front view of the golf club head of FIG. 3, shown with an oxidation-prevention coating non-permanently covering a strike face of the golf club head, according to one or more examples of the present disclosure.
Figure 8:
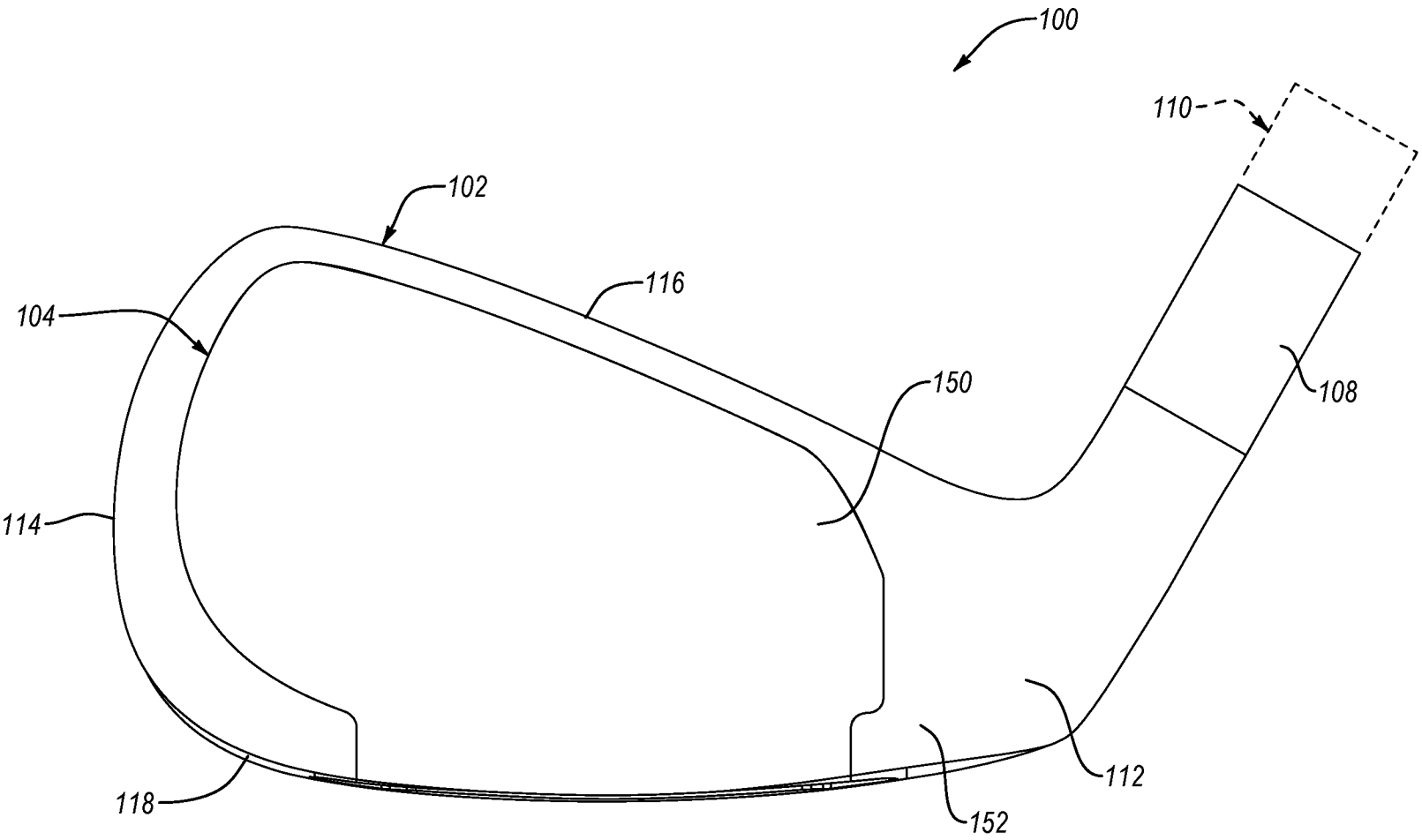
FIG. 8 is a front view of the golf club head of FIG. 5, shown with an oxidation-prevention coating non-permanently covering a strike face of the golf club head, according to one or more examples of the present disclosure.

In some examples, as shown in FIG. 6, a non-stick tab 193 is coupled to a periphery of the second oxidation-prevention coating 150 to facilitate manual peeling of the second oxidation-prevention coating 150 away from the golf club head 100. For example, a user can manually grasp the tab 193, which does not stick to the surface of the golf club head 100, and pull the tab 193 away from the golf club head 100 to remove the second oxidation-prevention coating 150 from golf club head 100.

According to another example, the second oxidation-prevention coating 150 is made of a material that is removable from the strike face 106 by the application of heat. For instance, the second oxidation-prevention coating 150 can be made of wax or foam, which can be removed or debonded from strike face 106 by applying heat to the wax to effectually melt the wax off of the strike face 106. In one implementation, the wax can be exposed to hot water, which acts to melt the wax and transport the wax away from the strike face 106.

In yet another example, the second oxidation-prevention coating 150 is made of a material that is removable from the strike face 106 by the application of a fluid, such as water, or a chemical. According to one implementation, the second oxidation-prevention coating 150 can be made from a water-soluble material, such as water-soluble paper (e.g., rice paper) that dissolves in the presence of water. Accordingly, in such an implementation, the iron-type golf club head 100 can be submersed in water to facilitate removal of the second oxidation-prevention coating 150 from the strike face 106.

The second oxidation-prevention coating 150 itself can include indicia of various kinds. For example, the second oxidation-prevention coating 150 may include indicia printed on, embossed in, or otherwise incorporated into the second oxidation-prevention coating 150. In a specific example, the second oxidation-prevention coating 150 has one of various colors, with each color representing a different possible characteristic (e.g., loft, bounce, lie, grind pattern, etc.) of the golf club head 100.

Figure 19:
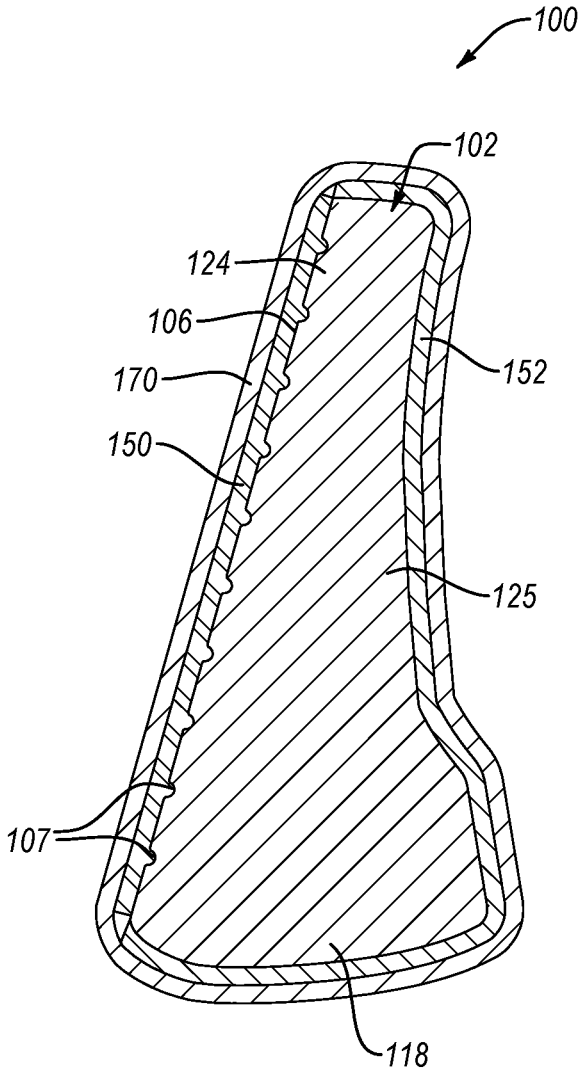
FIG. 19 is a cross-sectional side elevation view from a heel side of an iron-type golf club head, taken along a line similar to the line 9-9 of FIG. 2, according to one or more examples of the present disclosure.

Referring to FIG. 19, according to some examples, the second oxidation-prevention coating 150 is made of an oil-based material that restricts oxidation formation. Because the oil-based material may evaporate when exposed to air, the oil-based material and the strike face 106 can be sealed to help prevent the evaporation of the oil-based material. In the illustrated example, the oil-based material of the second oxidation-prevention coating 150 and the strike face 106 is sealed by a wrap 170 that envelopes the iron-type golf club head 100. The wrap 170 can be a plastic-based shrink wrap. Removal of the second oxidation prevention coating 150 is facilitated by the removal of the wrap 170 from the iron-type golf club head 100. After the wrap 170 is removed, the oil-based material can be removed naturally over time as the oil-based material evaporates. Alternatively, after the wrap 170 is removed, the oil-based material can be artificially removed, such as by cleaning, wiping, scrubbing, etc. the oil-based material from the strike face 106. Additionally, or alternatively, the second oxidation-prevention coating 150 may include one or more layers of plastic-based shrink wrap, such as two or more layers of plastic-based shrink wrap. The wrap 170 can be used with any type of second oxidation prevention coating 150, such as a sticker or tape, and is not confined to use with a second oxidation prevention coating 150 made of an oil-based material. Moreover, in certain examples, a third layer (e.g., sticker) can be applied to the outer surface of the second oxidation-prevention coating 150, such that the third layer is interposed between the second oxidation-prevention coating 150 and the wrap 170. The third layer can provide information about the golf club head 100 in some examples.

It is recognized that in some examples, the second oxidation-prevention coating 150 is removed from the strike face 106 by striking golf balls with the golf club head 100 and wearing out the second oxidation-prevention coating 150 over time.

As shown in FIG. 9, in some examples, although the second oxidation-prevention coating 150 covers the outer planar surface and the grooves 107 of the strike face 106, the second oxidation-prevention coating 150 forms a seal against only the outer planar surface and not the grooves 107. In other words, the second oxidation-prevention coating 150 does not penetrate into and make contact with the surfaces of the grooves 107. Because the surfaces of the grooves 107 are not sealed against the second oxidation-prevention coating 150, the grooves 107 are allowed to oxidize while the outer planar surface of the strike face 106 is prevented from oxidizing.

Figure 10:
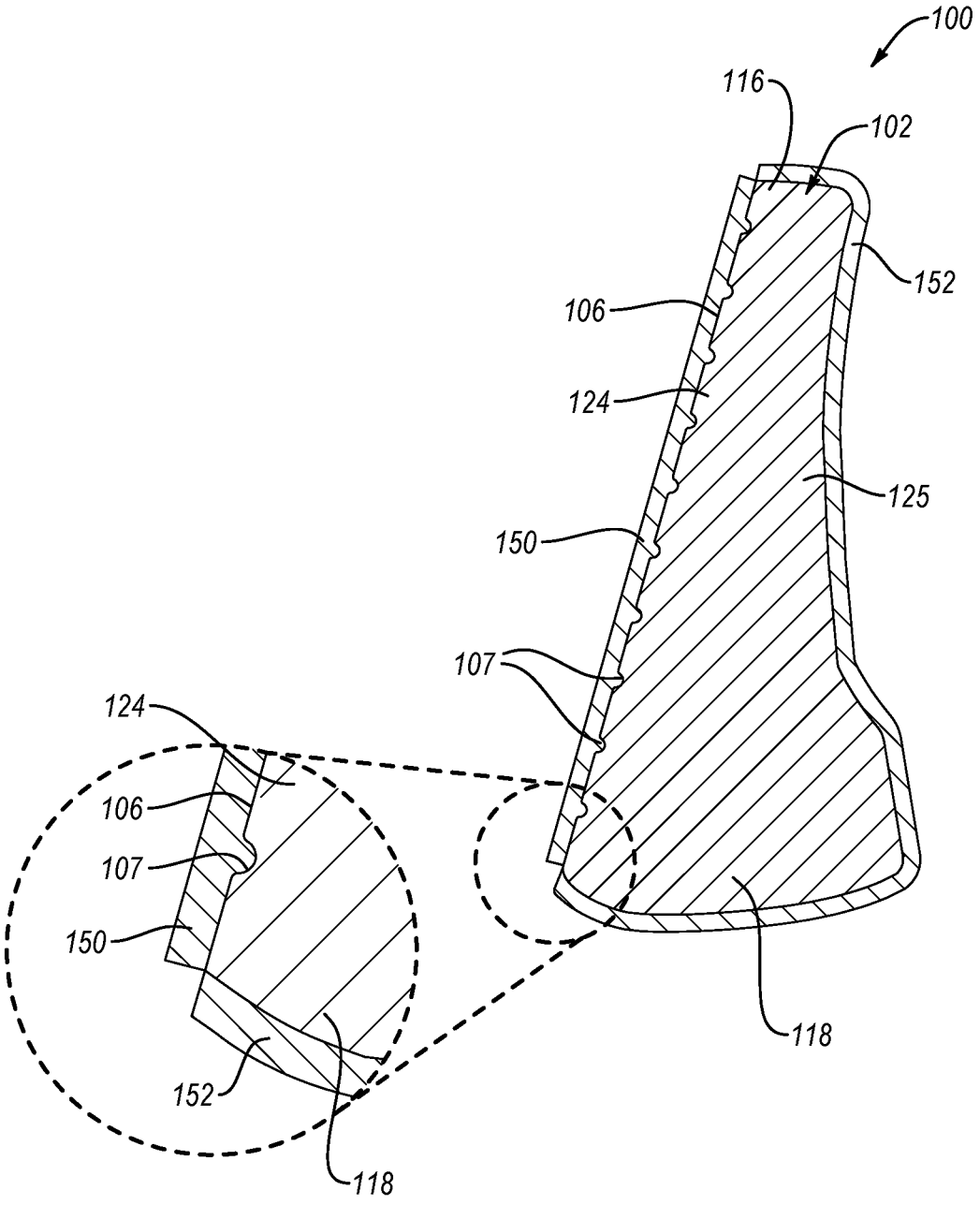
FIG. 10 is a cross-sectional side elevation view from a heel side of the golf club head of FIG. 1, taken along the line 9-9 of FIG. 2, according to one or more examples of the present disclosure.

In contrast, as shown in FIG. 10, in some examples, the second oxidation-prevention coating 150 forms a seal against both the outer planar surface and the grooves 107 of the strike face 106. In other words, the second oxidation-prevention coating 150 penetrates into and make contacts with the surfaces of the grooves 107. Because the surfaces of the grooves 107 are sealed against the second oxidation-prevention coating 150, the grooves 107, along with the outer planar surface of the strike face 106, are prevented from oxidizing.

Any portions of the strike face 106 not covered and sealed by the second oxidation-prevention coating 150 are subject to oxidation while the portion or portions of the strike face 106 covered and sealed by the second oxidation-prevention coating 150 are not subject to oxidation. The unsealed portions of the strike face 106 may begin to oxidize before the second oxidation-prevention coating 150 is removed from the sealed portions of the strike face 106. Accordingly, the unsealed portions of the strike face 106 may have a more advanced form of oxidation than the sealed portions of the strike face 106 at any point in time. Generally, more advanced stages of oxidation have a different visual appearance than less advanced stages of oxidation. The difference in the oxidation stages between the unsealed portions and the sealed portions (after the second oxidation-prevention coating 150 is removed from the sealed portions) creates a visual distinction between the unsealed and sealed portions of the strike face 106. In this manner, in applicable examples of the iron-type golf club head 100, the indicia on the strike face 106, as presented above, are defined by the contrast between different stages of oxidation on the strike face 106.

The oxidation-defined indicia formed on the strike face 106 can be the portions of the strike face 106 with more advanced oxidation (e.g., those portions not covered or sealed by the second oxidation-prevention coating 150) or the portions of the strike face 106 with no or less advanced oxidation (e.g., those portions covered and sealed by the second oxidation-prevention coating 150). Accordingly, the indicia on the strike face 106 can be formed with the positive space (e.g., solid material) of the second oxidation-prevention coasting 150 or the negative space (e.g., openings 164) of the second oxidation-prevention coating 150.

As one example corresponding with performance indicia, the performance indicia is the more advanced oxidation portions of the strike face 106 created by the indicia-shaped openings 164 in the second oxidation-prevention coating 150, such as those shown in FIG. 13. In a contrasting example corresponding with performance indicia, the performance indicia is the less advanced oxidation portions of the strike face 106 created by the indicia-shaped solid material in the second oxidation-prevention coating 150, such as that shown in FIG. 16.

As one example corresponding with informational indicia, the informational indicia is the more advanced oxidation portions of the strike face 106 created by the indicia-shaped openings 164 in the second oxidation-prevention coating 150, such as those shown in FIG. 14. In a contrasting example corresponding with informational indicia, the informational indicia are the less advanced oxidation portions of the strike face 106 created by the indicia-shaped solid material in the second oxidation-prevention coating 150, such as that shown in FIG. 17.

In yet another example corresponding with cosmetic indicia, the cosmetic indicia are the more advanced oxidation portions of the strike face 106 created by the indicia-shaped openings 164 in the second oxidation-prevention coating 150, such as those shown in FIG. 15. In a contrasting example corresponding with cosmetic indicia, the cosmetic indicia are the less advanced oxidation portions of the strike face 106 created by the indicia-shaped solid material in the second oxidation-prevention coating 150, such as that shown in FIG. 18.

Figure 25:
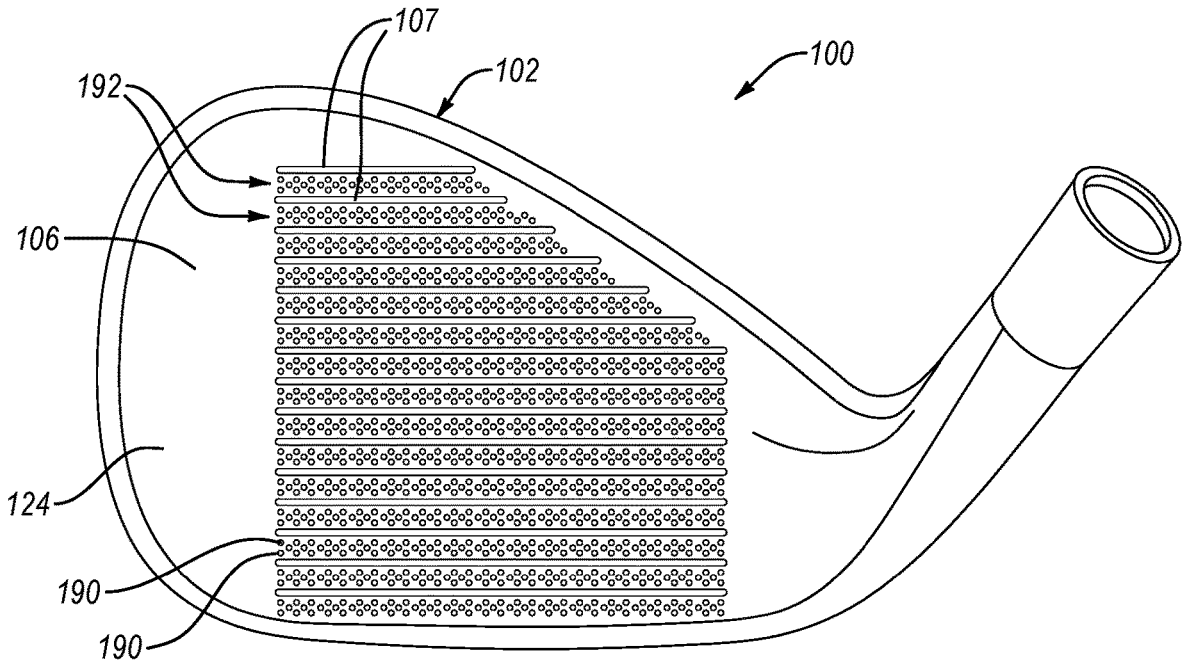
FIG. 25 is a front view of a golf club head with auxiliary grooves formed into a strike face of the golf club head, according to one or more examples of the present disclosure.
Figure 26:
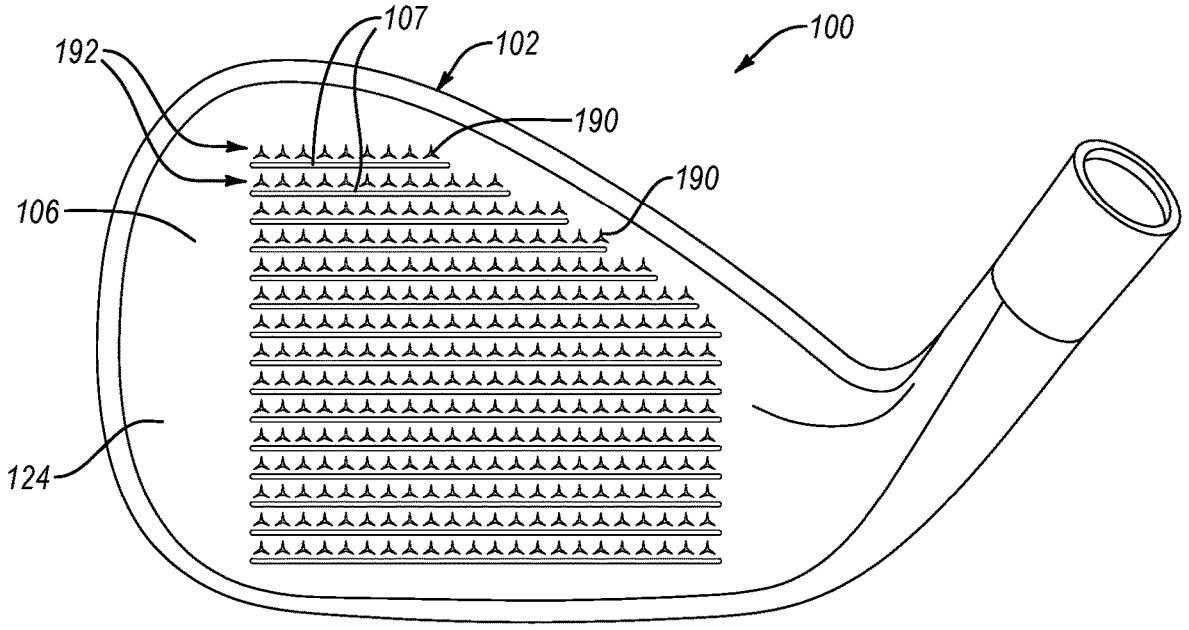
FIG. 26 is a front view of a golf club head with auxiliary grooves formed into a strike face of the golf club head, according to one or more examples of the present disclosure.
Figure 27:
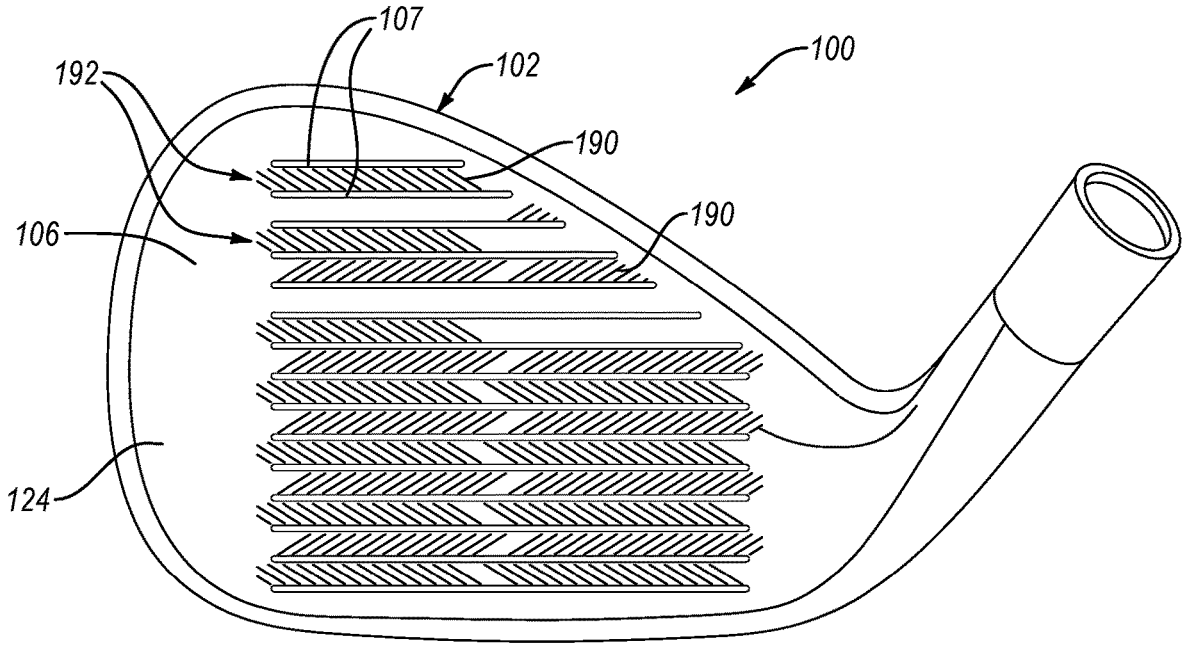
FIG. 27 is a front view of a golf club head with auxiliary grooves formed into a strike face of the golf club head, according to one or more examples of the present disclosure.

In some examples, as shown in FIGS. 25-27, a golf club head 100 of the present disclosure includes a strike face 106 that is made of an oxidizable material (i.e., a raw face) and includes auxiliary grooves 190 formed into the strike face 106. The auxiliary grooves 190 are separate from the grooves 107 (e.g., main grooves) or scorelines. Accordingly, in certain implementations, the auxiliary grooves 190 are spaced apart from the grooves 107. In the illustrated example, the auxiliary grooves 190 are formed into the strike face 106 at locations between and adjacent to the grooves 107. The strike face 106 between all or only some of the grooves 107 may include auxiliary grooves 190. The auxiliary grooves 190 are configured to increase the surface roughness of the strike face 106 to promote the ball striking performance (e.g., spin, feel, etc.) of the golf club head 100. Accordingly, the auxiliary grooves 190 help to supplement the added surface roughness provided by the raw surface of the strike face 106 when oxidized.

The auxiliary grooves 190 are formed, shaped, and patterned, in any of various ways, such as shown and described in U.S. Pat. No. 9,975,014, issued May 22, 2018, which is incorporated herein by reference. Generally, the auxiliary grooves 190 are narrower and shallower than the grooves 107. Moreover, the auxiliary grooves 190 can be shorter than the grooves 107. The auxiliary grooves 190 are formed into the strike face 106 according to any of various methods, such as etching (e.g., laser etching or chemical etching), machining (e.g., milling or electrical discharge machining (EDM)), engraving, and the like.

Each auxiliary groove 190 can have any of various shapes. In FIG. 25, for example, each auxiliary groove 190 has a hexagonal shape. In FIG. 26, for example, each auxiliary groove 190 has a tri-pointed star shape. In FIG. 27, for example, each auxiliary groove 190 is a linear dash or line. Although not shown, in other examples, each auxiliary groove 190 can have various other shapes, such as, but not limited to, X-shaped, sinusoid-shaped, arc-shaped, dollar-sign-shaped, asterisk-shaped, emoji-shaped, triangular-shaped, circular-shaped, letter-shaped, and the like. In still other examples, each auxiliary groove 190 can have other shapes, such as, but not limited to, rectangular and star shaped, as well as triangles, polygons, including, but not limited to, concave polygons, constructible polygons, convex polygons, cyclic polygons, decagons, digons, dodecagons, enneagons, equiangular polygons, equilateral polygons, henagons, hendecagons, heptagons, hexagons, Lemoine hexagons, Tucker hexagons, icosagons, octagons, pentagons, regular polygons, stars, and star polygons; triangles, including, but not limited to, acute triangles, anticomplementary triangles, equilateral triangles, excentral triangles, tritangent triangles, isosceles triangles, medial triangles, auxiliary triangles, obtuse triangles, rational triangles, right triangles, scalene triangles, Reuleaux triangles; parallelograms, including, but not limited to, equilateral parallelograms: rhombuses, rhomboids, and Wittenbauer's parallelograms; Penrose tiles; rectangles; rhombus; squares; trapezium; quadrilaterals, including, but not limited to, cyclic quadrilaterals, tetrachords, chordal tetragons, and Brahmagupta's trapezium; equilic quadrilateral kites; rational quadrilaterals; strombus; tangential quadrilaterals; tangential tetragons; trapezoids; polydrafters; annulus; arbelos; circles; circular sectors; circular segments; crescents; tunes; ovals; Reuleaux polygons; rotors; spheres; semicircles; triquetras; Archimedean spirals; astroids; paracycles; cubocycloids; deltoids; ellipses; smoothed octagons; super ellipses; and tomahawks; polyhedra; prisms; pyramids; and sections thereof.

The auxiliary grooves 190 are grouped together to form patterns 192 of auxiliary grooves 190. Each pattern 192 of auxiliary grooves 190 can be located between corresponding adjacent grooves 107. Generally, each pattern 192 of auxiliary grooves 190 is defined by a series or array of auxiliary grooves 190 in relatively close proximity to each other compared to the auxiliary grooves 190 of other patterns 192 of auxiliary grooves 190. In some examples, such as shown in FIGS. 25 and 26, the auxiliary grooves 190 of a pattern 192 are spaced an equal distance apart from adjacent auxiliary grooves 190 of the pattern. In some examples, the patterns 192 of auxiliary grooves 190 on the strike face 106 are the same (e.g., a "====" pattern of dashes). However, in other examples, as shown in FIG. 27, the patterns 192 of auxiliary grooves 190 on the strike face 106 may be different (e.g., alternate like the "herringbone" pattern of FIG. 27). According to some examples, the auxiliary grooves 190 are covered by a second oxidation-prevention coating 150. However, in other examples, the second oxidation-prevention coating 150 is configured such that the auxiliary grooves 190 are not covered by the second oxidation-prevention coating 150. Add dash-dash ====

According to one example, an entirety or a portion of the strike face 106 can be permanently covered by an oxidation-prevention coating 152 and burn marks (e.g., auxiliary grooves) can be etched into the oxidation-prevention coating 152 up to, and including in some implementations, an underlying oxidizable material. The underlying oxidizable material, being exposed to air, is thus allowed to oxidize, while the oxidation prevention coating 152 on the strike face 106 prevents oxidation of the underlying oxidizable material. The burn marks can be located between grooves 107 on the strike face 106.

Figure 20:
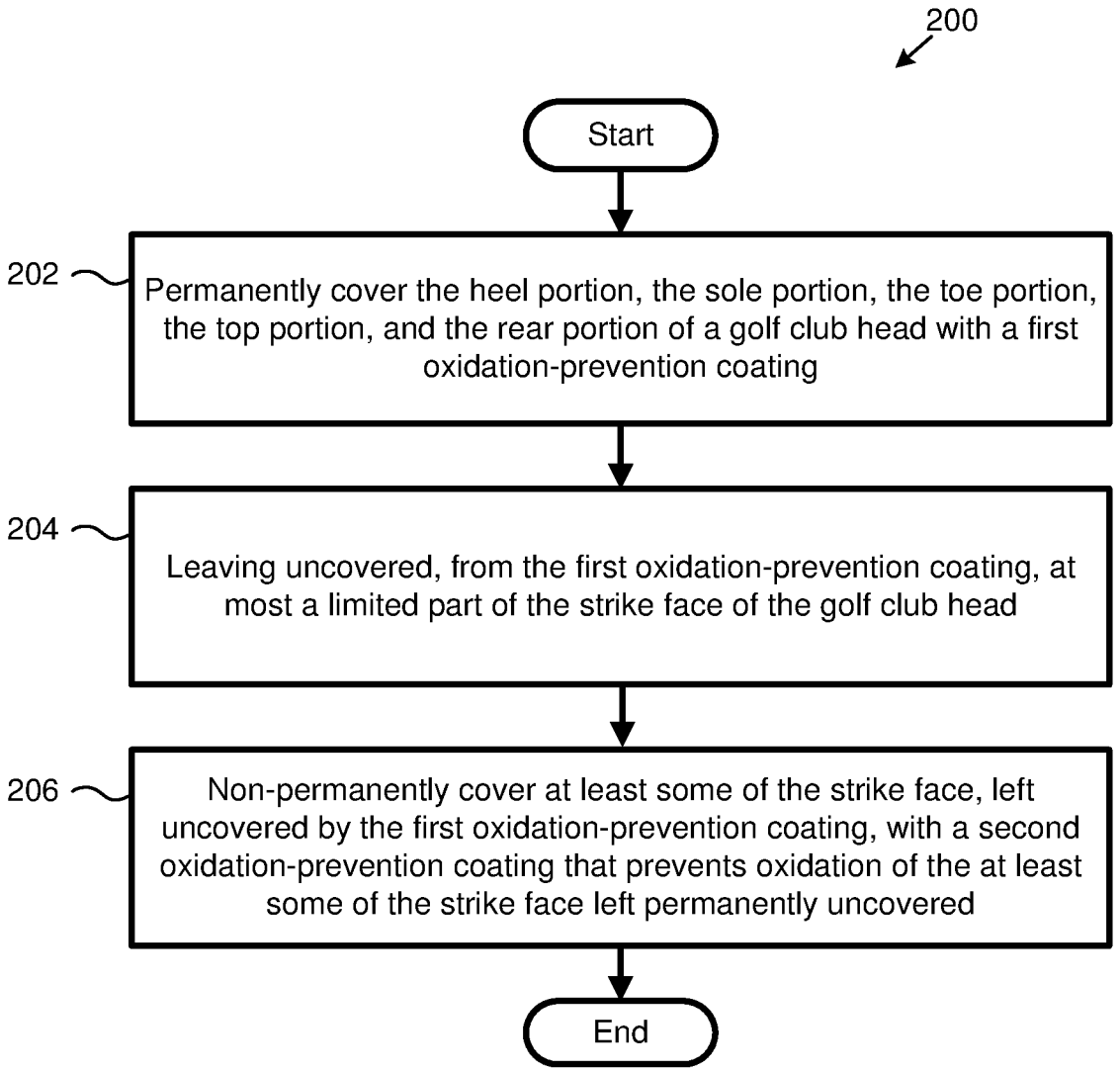
FIG. 20 is a schematic flow chart of a method of making a golf club head, according to one or more examples of the present disclosure.

Referring to FIG. 20, according to one example, a method 200 for making the iron-type golf club head 100 is shown. The method 200 includes permanently covering the heel portion 112, the sole portion 118, the toe portion 114, the top portion 116, and the rear portion 125 of the iron-type golf club head 100 with the first oxidation-prevention coating 152 at 202. The method 200 further includes leaving uncovered, from the first oxidation-prevention coating 152, at most a limited part of the strike face 106 of the iron-type golf club head 100 at 204. The method 200 also includes non-permanently covering at least some of the strike face 106, left uncovered by the first oxidation-prevention coating 152, with a second oxidation-prevention coating 150 that prevents oxidation of the at least some of the strike face left permanently uncovered at 206.

In some examples, the method 200 further includes selectively removing the second oxidation-prevention coating 150 from the at least some of the strike face 106 left permanently uncovered and oxidizing the at least some of the strike face 106 left permanently uncovered. Selectively removing the second oxidation-prevention coating 150 can include one of dissolving, evaporating, or melting the second oxidation-prevention coating 150.

According to certain examples, permanently covering the heel portion 112, the sole portion 118, the toe portion 114, the top portion 116, and the rear portion 125 of the iron-type golf club head 100 with the first oxidation-prevention coating 152 at 202 includes dipping the golf club head 100 in a bath of plating material. Additionally, leaving uncovered, from the first oxidation-prevention coating 152, at most a limited part of the strike face 106 at 204 includes covering the at most a limited part of the strike face 106 with a masking material prior to dipping the golf club head 100 in the bath of plating material and, after dipping the golf club head 100 in the bath of plating material, removing the masking material from the at most a limited part of the strike face 106. In some examples, the masking material is a paint that is sandblasted off of the strike face 106 after the body 102 is coated with the first oxidation-prevention coating 152.

Additional examples of permanently covering the heel portion 112, the sole portion 118, the toe portion 114, the top portion 116, and the rear portion 125 of the iron-type golf club head 100 with the first oxidation-prevention coating 152 at 202 include one or more of painting the portions with the first oxidation-prevention coating 152, depositing the first oxidation-prevention coating 152 on the portions using a physical vapor deposition (PVD) technique (such as the one described in U.S. Pat. No. 9,440,121, which is incorporated herein by reference), and quench-polish-quenching the first oxidation-prevention coating 152 onto the portions. Accordingly, as used herein, the first oxidation-prevention coating 152 can be any material or material treatment that is intended to permanently (as defined above) protect an underlying substrate.

In yet other examples of the method 200, the front portion 124 includes a strike plate 104 that defines the strike face 106 and the method 200 further includes forming the strike plate 104 separately from the heel portion 112, the sole portion 118, the toe portion 114, the top portion 116, and the rear portion 125. Permanently covering the heel portion 112, the sole portion 118, the toe portion 114, the top portion 116, and the rear portion 125 of the iron-type golf club head 100 with the first oxidation-prevention coating 152 at 202 can include dipping only the heel portion 112, the sole portion 118, the toe portion 114, the top portion 116, and the rear portion 125 in a bath of plating material. Furthermore, leaving uncovered, from the first oxidation-prevention coating 152, at most a limited part of the strike face 106 at 204 includes attaching the strike plate 104 to the front portion 124 after permanently covering the heel portion 112, the sole portion 118, the toe portion 114, the top portion 116, and the rear portion 125 with the first oxidation-prevention coating 152.

Figure 21:
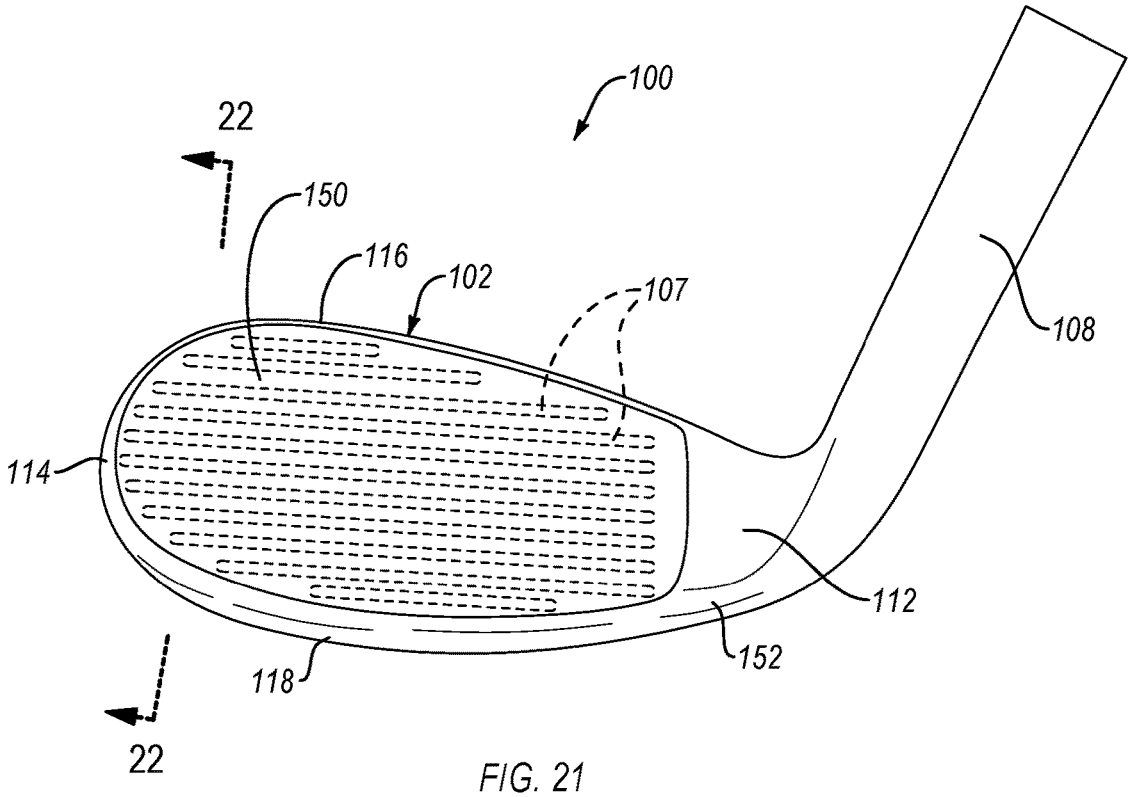
FIG. 21 is a front view of an iron-type golf club head, according to one or more examples of the present disclosure.
Figure 22:
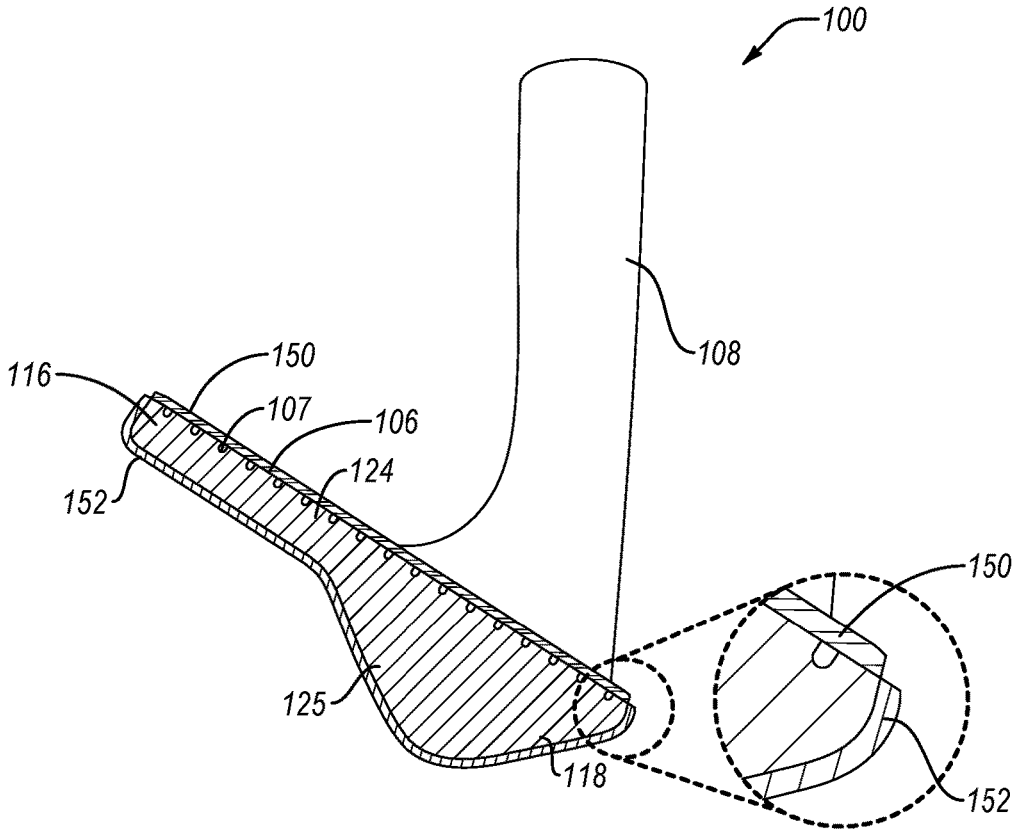
FIG. 22 is a cross-sectional side elevation view from a toe side of the golf club head of FIG. 21, taken along the line 22-22 of FIG. 21, according to one or more examples of the present disclosure.

The iron-type golf club head 100 can be any of various high-lofted, mid-lofted, or low-lofted iron-type golf club heads. In the examples of FIGS. 1-19, the iron-type golf club head 100 is depicted as a low-lofted or mid-lofted iron-type golf club head. However, in other examples, such as shown in FIGS. 21 and 22, the iron-type golf club head 100 can be a high-lofted iron-type golf club head, such as any of various wedges. A raw strike face 106 can be particularly beneficial to high-lofted iron-type golf club heads when high spin of the golf ball off the strike face 106 is desirable. The wedge iron-type golf club head 100 of FIGS. 21 and 22 includes grooves 107 (shown in dashed lines) that traverse substantially an entirety of the face portion 124 in heel-to-toe directions. In this embodiment, the second oxidation-prevention coating 150 covers the entirety of the face portion 124 and the first oxidation-prevention coating 152 covers the rest of the body 102.

According to some embodiments, the iron-type golf club head 100 of the present disclosure may have a Z-up value between 16 mm and 23 mm. The Z-up value is the distance between the center-of-gravity of the golf club head 100 and a horizontal plane when the golf club head 100 is resting on the horizontal plane in a proper address position. According to a few examples, the Z-up value of the iron-type golf club head 100 can be proportional with the loft of the golf club head 100. In other words, for golf club heads with higher loft, the Z-up value is higher. Such progressive adjustment to the Z-up value helps to promote distance and trajectory control. Additionally, or alternatively, the Zup value of the iron-type golf club head may vary by no more than 1 mm within four degree loft differences. For example, a 52 degrees wedge may have a Zup of 20 mm, and a 56 degree wedge may have a Zup between 19 mm to 21 mm. In yet certain embodiments, the part of the front portion 124 of the golf club head 100, which defines the strike face 106, has a thickness between 4.8 mm and 6.2 mm.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, can be defined to mean within +/−5% of a given value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A golf club head, comprising:

a body formed of oxidizable metal material, the body including:

a heel portion;

a sole portion;

a toe portion opposite the heel portion;

a top portion opposite the sole portion;

a rear portion; and a front portion opposite the rear portion and including a planar strike face having a plurality of grooves;

wherein:

a first oxidation-prevention coating covers at least a portion of the body including a portion of the rear portion, the heel portion, and the sole portion;

an entirety of the planar strike face, including all the surfaces of the plurality of grooves and all the surfaces between the plurality of grooves, is not covered by the first oxidation-prevention coating;

a second oxidation-prevention coating is removably attached to at least a portion of the planar strike face via an adhesive material, wherein the second oxidation-prevention coating is a non-metallic material; and the second oxidation-prevention coating is formed with an opening to expose a portion of the planar striking face.

2. The golf club head according to claim 1, wherein the adhesive adheres the second oxidation-prevention coating to the strike face with an adhesion strength, with respect to the oxidizable metal material, of within 0.15 and 1.35 of 26 oz/in (280 N/m).

3. The golf club head according to claim 1, wherein the non-permanent second oxidation-prevention coating includes a non-stick tab coupled to the second oxidation-prevention coating.

4. The golf club head according to claim 1, wherein the second oxidation-prevention coating seals an underlying area of the planar striking face from environmental exposure thereby inhibiting oxidation until removal of the second oxidation-prevention coating.

5. The iron-type golf club head according to claim 1, further comprising a non-stick tab coupled to a periphery of the second oxidation-prevention coating.

6. An iron-type golf club head, comprising:

a body formed of an oxidizable metal material, the body comprising:

a heel portion;

a sole portion;

a toe portion opposite the heel portion;

a top portion opposite the sole portion;

a rear portion; and a front portion opposite the rear portion and including a planar strike face having a plurality of grooves;

wherein:

all the surfaces of the plurality of grooves and all the surfaces between the plurality of grooves, are exposed oxidizable metal material; and a first oxidation-prevention coating permanently covers and prevents oxidation of at least a portion of the body including at least a portion of the rear portion and the heel portion, wherein a surface area of the planar strike face is not permanently covered by the first oxidation-prevention coating;

the surface area of the planar strike face not permanently covered by the first oxidation-prevention coating divided by the total volume of the body is at least 0.05 per mm, inclusive, and a ratio of the surface area of the planar strike face not permanently covered by the first oxidation-prevention coating divided by the total surface area of the planar strike face is at least 0.70, inclusive;

the total volume of the body excludes a hosel portion of the body and is measured from a par line of the golf club head to a toe-ward most portion of the golf club head;

a second oxidation-prevention coating is temporarily and removably attached to at least a portion of to the planar strike face, wherein the non-permanent second oxidation-prevention coating is a non-metallic material; and the second oxidation-prevention coating is formed with an opening to expose a portion of the planar striking face.

7. The iron-type golf club head according to claim 6, wherein the first oxidation-prevention coating comprises a copper alloy.

8. The iron-type golf club head according to claim 6, wherein the first oxidation-prevention coating comprises a nickel alloy.

9. The iron-type golf club head according to claim 6, wherein the first oxidation-prevention coating comprises a chrome alloy, wherein the surface area of the planar strike face not permanently covered by the first oxidation-prevention coating divided by the total volume of the body is no more than 0.12 per mm, and the ratio of the surface area of the planar strike face not permanently covered by the first oxidation-prevention coating divided by the total surface area of the planar strike face is at least 0.75.

10. The iron-type golf club head according to claim 6, wherein the first oxidation-prevention coating is formed using a physical vapor deposition (PVD) technique.

11. The iron-type golf club head according to claim 6, wherein the first oxidation-prevention coating is formed using a quench-polish-quenching (QPQ) technique, and the second oxidation-prevention coating is formed with an opening to expose a portion of the planar striking face through the second oxidation-prevention coating.

12. The golf club head according to claim 1, wherein each of the plurality of grooves has a most-toeward end, and the most-toeward end of at least two of the plurality of grooves are not vertically aligned, the planar strike face is milled and has a loft of 45 degrees or more, and the rear portion includes at least two circular cavities.

* * * * *